US009567184B2

(12) United States Patent
Kanemaru

(10) Patent No.: US 9,567,184 B2
(45) Date of Patent: Feb. 14, 2017

(54) SHEET STORING APPARATUS AND IMAGE FORMING SYSTEM HAVING THE SAME

(71) Applicant: Yuki Kanemaru, Yamanashi-ken (JP)

(72) Inventor: Yuki Kanemaru, Yamanashi-ken (JP)

(73) Assignees: CANON FINETECH INC., Misato-Shi, Saitama-Ken (JP); NISCA CORPORATION, Minamikoma-Gun, Yamanashi-Ken (JP)

( * ) Notice: Subject to any disclaimer, the term of this patent is extended or adjusted under 35 U.S.C. 154(b) by 38 days.

(21) Appl. No.: 14/572,174

(22) Filed: Dec. 16, 2014

(65) Prior Publication Data

US 2015/0166295 A1 Jun. 18, 2015

(30) Foreign Application Priority Data

Dec. 17, 2013 (JP) ..... 2013-260096

(51) Int. Cl.
*B65H 37/04* (2006.01)
*B65H 31/02* (2006.01)
(Continued)

(52) U.S. Cl.
CPC ..... *B65H 37/04* (2013.01); *B65H 9/04* (2013.01); *B65H 31/02* (2013.01); *G03G 15/6541* (2013.01); *B65H 2301/43828* (2013.01); *B65H 2402/441* (2013.01); *B65H 2402/442* (2013.01); *B65H 2407/10* (2013.01); *B65H 2407/21* (2013.01); *B65H 2407/50* (2013.01);
(Continued)

(58) Field of Classification Search
CPC ..... B65H 37/04; B65H 31/02; B65H 9/04; B65H 2801/27; G03G 21/1633; G03G 2221/1672; G03G 2215/00544
USPC ..... 270/37, 58.07, 58.08, 58.11, 58.12,270/58.17; 399/110, 324
See application file for complete search history.

(56) References Cited

U.S. PATENT DOCUMENTS 5,213,317 A * 5/1993 Mandel ..... B42C 9/0056 270/58.11
5,342,034 A * 8/1994 Mandel ..... B42C 1/125 109/56
(Continued)

FOREIGN PATENT DOCUMENTS

CN 100560458 C 11/2009
CN 101900961 A 12/2010
(Continued)

OTHER PUBLICATIONS

China Patent Office, "Office Action for Chinese Patent Application No. 201410784484.3," May 5, 2016.

*Primary Examiner* — Leslie A Nicholson, III
(74) *Attorney, Agent, or Firm* — Manabu Kanesaka

(57) ABSTRACT

To provide an apparatus capable of stably performing a binding process on a sheet bundle which is set from the outside as having a setting portion arranged at an external cover of a sheet storing apparatus. In an apparatus including a setting portion arranged at an external cover as being capable of setting a sheet bundle from the outside, the setting portion includes a opening, a setting face on which sheets inserted through the opening are placed, and an abutting-regulating face which performs positioning of end edges of the sheets inserted, the opening is arranged at an open-close cover of the external cover, and the abutting-regulating face are arranged at an apparatus frame which is located at the inner side of the open-close cover.

16 Claims, 17 Drawing Sheets

(51) Int. Cl.
*B65H 9/04* (2006.01)
*G03G 15/00* (2006.01)
*G03G 21/16* (2006.01)

(52) U.S. Cl.
CPC ..... *B65H 2801/27* (2013.01); *G03G 21/1633* (2013.01); *G03G 2215/00544* (2013.01); *G03G 2221/1672* (2013.01)

(56) References Cited

U.S. PATENT DOCUMENTS 5,525,031 A * 6/1996 Fox ..... B65H 39/11 399/404
6,328,298 B1 * 12/2001 Suzuki ..... B42C 1/12 270/58.02
6,398,203 B1 * 6/2002 Saito ..... B41J 13/106 227/150
7,380,779 B2 * 6/2008 Nakamura ..... B65H 5/26 270/58.01
7,949,294 B2 * 5/2011 Nagata ..... H04N 1/00525 399/407
7,992,864 B2 * 8/2011 Shirasaki ..... B42C 1/12 270/58.01
8,104,757 B2 * 1/2012 Taki ..... B42B 4/00 270/58.08
2006/0018693 A1 1/2006 Nobe et al.
2011/0033218 A1 2/2011 Sasahara
2013/0043637 A1 2/2013 Awano

FOREIGN PATENT DOCUMENTS

CN 101900961 A 3/2011
JP H02-56369 A 2/1990
JP 2005-096392 A 4/2005
JP 2009-051661 A 3/2009
JP 2010-159144 A 7/2010

* cited by examiner

SHEET STORING APPARATUS AND IMAGE FORMING SYSTEM HAVING THE SAME

RELATED APPLICATIONS

The present application is based on, and claims priority from, Japanese Application No. 2013-260096 filed Dec. 17, 2013, the disclosure of which is hereby incorporated by reference herein in its entirety.

BACKGROUND OF THE INVENTION

1. Field of the Invention

The present invention relates to a sheet storing apparatus which stacks and stores image-formed sheets, and relates to improvement of a manual setting mechanism for performing a binding process on a sheet bundle which is manually inserted from the outside.

2. Description of Related Arts

In general, such an apparatus is arranged at the downstream side of an image forming apparatus. Such an apparatus has been widely used as a sheet storing apparatus which receives image-formed sheets and stacks and stores the sheets on a tray. Further, there has been also known a post-processing apparatus which stores, at a stack tray, sheets received from an image forming apparatus after performing a post-processing thereon such as a binding process, a folding process, and a bookbinding process.

Japanese Patent Application Laid-open No. 2005-096392 discloses a sheet storing apparatus which stacks and stores image-formed sheets as being connected to a sheet discharging port of an image forming apparatus. Here, it is proposed to adopt a mechanism for performing a binding process on a sheet bundle which is prepared offline by an operator while a manual binding portion for performing a binding process on a sheet bundle set from the outside is arranged at an external casing.

Further, Japanese Patent Application Laid-open No. 2010-159144 discloses a post-processing apparatus which performs a binding process on sheets fed from an image forming apparatus after stacking the sheets on a processing tray and stores the sheets on a stack tray at the downstream side.

SUMMARY OF THE INVENTION

As described above, in an image forming system, there has been already known an sheet storing apparatus for storing sheets, in which a manual insertion portion for setting a sheet bundle from the outside is arranged at an external cover thereof and a binding process is performed on the sheet bundle set at the insertion portion.

With such an apparatus, for example, when document sheets are read out for copying and a binding process is performed on the read document sheets, it is possible to perform the binding process after inserting the document sheets to the manual insertion portion which is arranged at the external cover.

With such an apparatus, it has been known that an openable-closable open-close cover is arranged at an external cover for a case of an error occurring in the apparatus or a case of replenishing consumables to a built-in device. Here, when the open-close cover is arranged at the manual insertion portion, there may arise a problem that sheets to be inserted from the outside become positionally unstable owing to rattling at an open-close hinge portion.

The present invention provides an apparatus capable of stably performing a binding process on a sheet bundle which is set from the outside as having a manual setting portion arranged at an external cover of a sheet storing apparatus.

In view of the above, an apparatus of the present invention includes a manual setting portion which is arranged at an external cover as being capable of setting a sheet bundle thereat from the outside. Here, the manual setting portion includes a slit-shaped opening, a setting face on which sheets inserted through the opening are placed, and an abutting-regulating face which performs positioning of end edges of the sheets inserted along the setting face.

For more detail, the apparatus includes an apparatus frame, the external cover which covers the apparatus frame, the setting portion which is arranged at a part of the external cover to set a sheet bundle, and a binding processing device which performs a binding process on a sheet bundle at the setting portion. The setting portion includes the setting face on which sheets inserted through the opening are placed and the abutting-regulating face which performs positioning of end edges of the sheets inserted through the opening.

Further, an openable-closable open-close cover is arranged at least at a part of the external cover, the opening is formed at the open-close cover, and the setting face and the abutting-regulating face are formed at the apparatus frame which is located at the inner side of the open-close cover.

The present invention has a structure capable of performing a binding process on a sheet bundle which is set from the outside while the manual setting portion to which the sheet bundle is inserted is arranged at the external cover. Here, the manual setting portion includes the slit-shaped opening which regulates a height of an object to be inserted thereto, the setting face, and the abutting-regulating face. The slit-shaped opening is formed at the openable-closable open-close cover. The setting face and the abutting-regulating face are arranged at the apparatus frame located at the inner side of the open-close cover. When the open-close cover is in an opened state, a space larger than the opening is formed in the vicinity of the binding processing device. According to the above, following effects are obtained.

The slit-shaped opening is arranged at the open-close cover of the external cover. The opening regulates a height of an object to be inserted thereto. The setting face and the abutting-regulating face are arranged at the apparatus frame located at the inner side of the open-close cover. According to the above structure, even when rattling occurs at the open-close cover due to repetition of open-close operations, a sheet bundle to be processed is positioned at a correct processing position owing to the setting face and the abutting-regulating face and is not influenced by the rattling of the open-close cover.

Further, since the slit-shaped opening at the open-close cover regulates a height of an object to be inserted thereto, a hand or a finger of an operator or a child is prevented from being inserted carelessly, so that unforeseen accidents are avoided.

Further, in an apparatus of the present invention with a post-processing portion arranged in the apparatus housing to stack and bind sheets fed from an introducing path, the post-processing portion and the manual setting portion are arranged to support a sheet bundle approximately on the same plane. Accordingly, a common binding unit (e.g., stapling device) is moved and a binding process can be performed on a sheet bundle at each processing portion.

BRIEF DESCRIPTION OF THE DRAWINGS

FIGS. 12A to 12C are operational explanatory views of a sheet bundle discharging device, while FIG. 12A illustrates a state that a sheet bundle is located at a binding position on the processing tray, FIG. 12B illustrates a midstream state of conveying the sheet bundle from a processing position to the downstream side, and FIG. 12C illustrates a state right before the sheet bundle is discharged to the stack tray at the downstream side;

FIGS. 13A and 13B illustrate structures of binding devices according to the present invention, while FIG. 13A is a structural explanatory view of the stapling unit and FIG. 13B is a structural explanatory view of the eco-binding unit:

FIGS. 17A and 17B illustrate flows of a sheet discharging mode with the apparatus of FIG. 1, while FIG. 17A is an operational flowchart of a bookbinding sheet discharging mode and FIG. 17B is an operational flowchart of a printout sheet discharging mode.

DETAILED DESCRIPTION OF THE PREFERRED EMBODIMENT

Image Forming Apparatus

Figure 1:
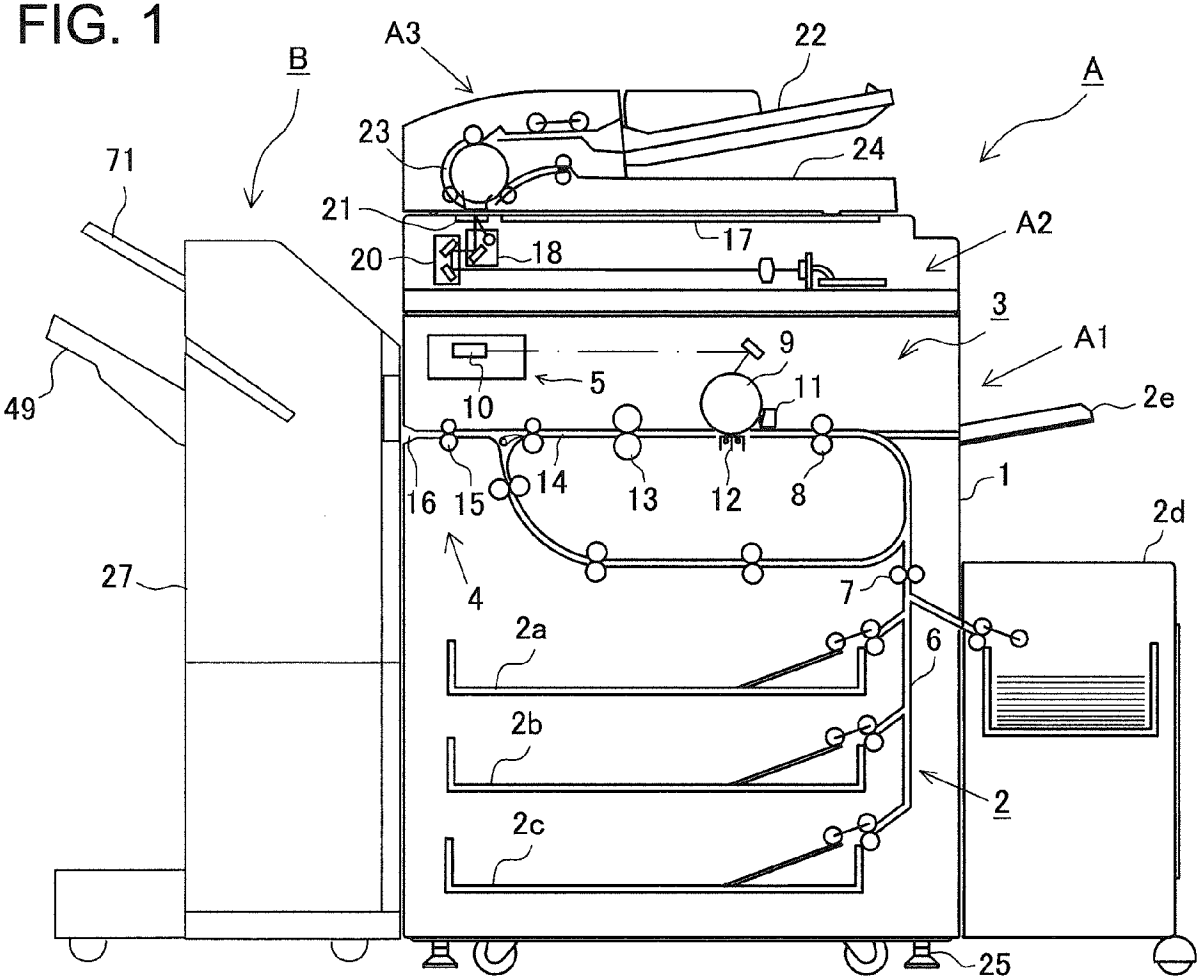
FIG. 1 is an explanatory view of a whole configuration of an image forming system according to the present invention.

Description will be provided on an image forming apparatus A in an image forming system illustrated in FIG. 1. In the drawing, the image forming apparatus A has an electrostatic printing mechanism as including an image forming unit A1, a scanner unit A2, and a feeder unit A3. Emplacement legs 25 for emplacing on an installation face (e.g., a floor face) are arranged at an apparatus housing 1. Further, the apparatus housing 1 accommodates a sheet feeding portion 2, an image forming portion 3, a sheet discharging portion 4, and a data processing portion 5.

The sheet feeding portion 2 is structured with cassette mechanisms 2*a* to 2*c* to store sheets having a plurality of sizes on which images are formed and feeds a sheet having a specified size from a main body controller 90 to a sheet feeding path 6. The plurality of cassettes 2*a* to 2*c* are arranged at the apparatus housing 1 in a detachably attachable manner. Each cassette contains a separating mechanism to separate stored sheets one by one and a sheet feeding mechanism to feed a sheet. A conveying roller 7 which feeds sheets fed from the plurality of cassettes 2*a* to 2*c* to the downstream side is arranged at the sheet feeding path 6. A pair of resist rollers 8 are arranged at an end of the path so that each sheet is aligned at a leading end thereof.

A large-capacity cassette 2*d* and a manual tray 2*e* are connected to the sheet feeding path 6. The large-capacity cassette 2*d* is structured as an optional unit which stores sheets having a size to be used in great quantities. The manual tray 2*e* is structured to be capable of feeding special sheets such as thick sheets, coating sheets, and film sheets which are difficult to be separately fed.

An electrostatic printing mechanism is illustrated as an example of the image forming portion 3. A photo conductor 9 (drum, belt), a light emitter 10 which emits an optical beam to the photo conductor 9, a developer 11, and a cleaner (not illustrated) are arranged around the photo conductor 9 which rotates. The drawing illustrates a monochrome printing mechanism. Here, a latent image is optically formed at the photo conductor 9 by the light emitter 10. The developer 11 causes toner ink to adhere to the latent image.

A sheet is fed from the sheet feeding path 6 to the image forming portion 3 in accordance with image-forming timing on the photo conductor 9. Then, the image is transferred onto the sheet at a transfer charger 12 and fixed by a fixing unit (roller) 13 which is arranged at the sheet discharging path 14. A sheet discharging roller 15 and a sheet discharging port 16 are arranged at the sheet discharging path 14 for conveying a sheet to a sheet post-processing apparatus B which is described later.

The scanner unit A2 is structured with a platen 17 on which an image document is placed, a carriage 18 which reciprocates along the platen 17, a light source which is mounted on the carriage 18, and a reducing optical system 20 (combination of a mirror and a lens) which guides reflection light from the document on the platen 17 to a photoelectric conversion device 19. A second platen (drive platen) 21 is illustrated in the drawing. The carriage 18 and the reducing optical system 20 read an image of the sheet fed from the feeder unit A3. The photoelectric conversion device 19 electrically transfers photoelectrically-converted image data to the image forming portion 3.

The feeder unit A3 is structured with a sheet feeding tray 22, a sheet feeding path 23 which guides a sheet fed from the sheet feed tray 22 to the drive platen 21, and a sheet discharge tray 24 which stores a document, an image of which is read at the drive platen 21.

Not limited to the abovementioned mechanism, the image forming apparatus A may adopt a printing mechanism such as an offset printing mechanism, an ink jet printing mechanism, and an ink ribbon transfer printing mechanism (thermal transfer ribbon printing, sublimation ribbon printing, or the like).

[Sheet Post-Processing Apparatus]

As an apparatus to perform post-processing on sheets discharged from the sheet discharging port 16 of the image forming apparatus A, the sheet post-processing apparatus B has following functions as;

(1) A function to stack and store image-formed sheets (first and third processing portions B1, B3; a printout mode), (2) A function to sort and store image-formed sheets (third processing portion B3; a jog sorting mode), (3) A function to collate and stack image-formed sheets and perform a binding process thereon (first processing portion B1; a binding processing mode), and (4) A function to perform bookbinding with a folding process after image-formed sheets are collated and a binding process is performed thereon (second processing portion B2; a bookbinding processing mode).

In the present invention, the sheet post-processing apparatus B is not necessarily required to have all the above-mentioned functions. The sheet post-processing apparatus B may be appropriately arranged in accordance with apparatus specifications (design specifications). Even in this case, it is required to include a processing portion (the first processing portion B1) which collates and stacks sheets and first and second binding devices (a staple binding unit 47 and a non-staple binding unit 51 which are described later) which are arranged at the processing portion. Further, it is required to have a stack structure to perform stacking after a binding process is performed with a selected binding device.

Figure 2:
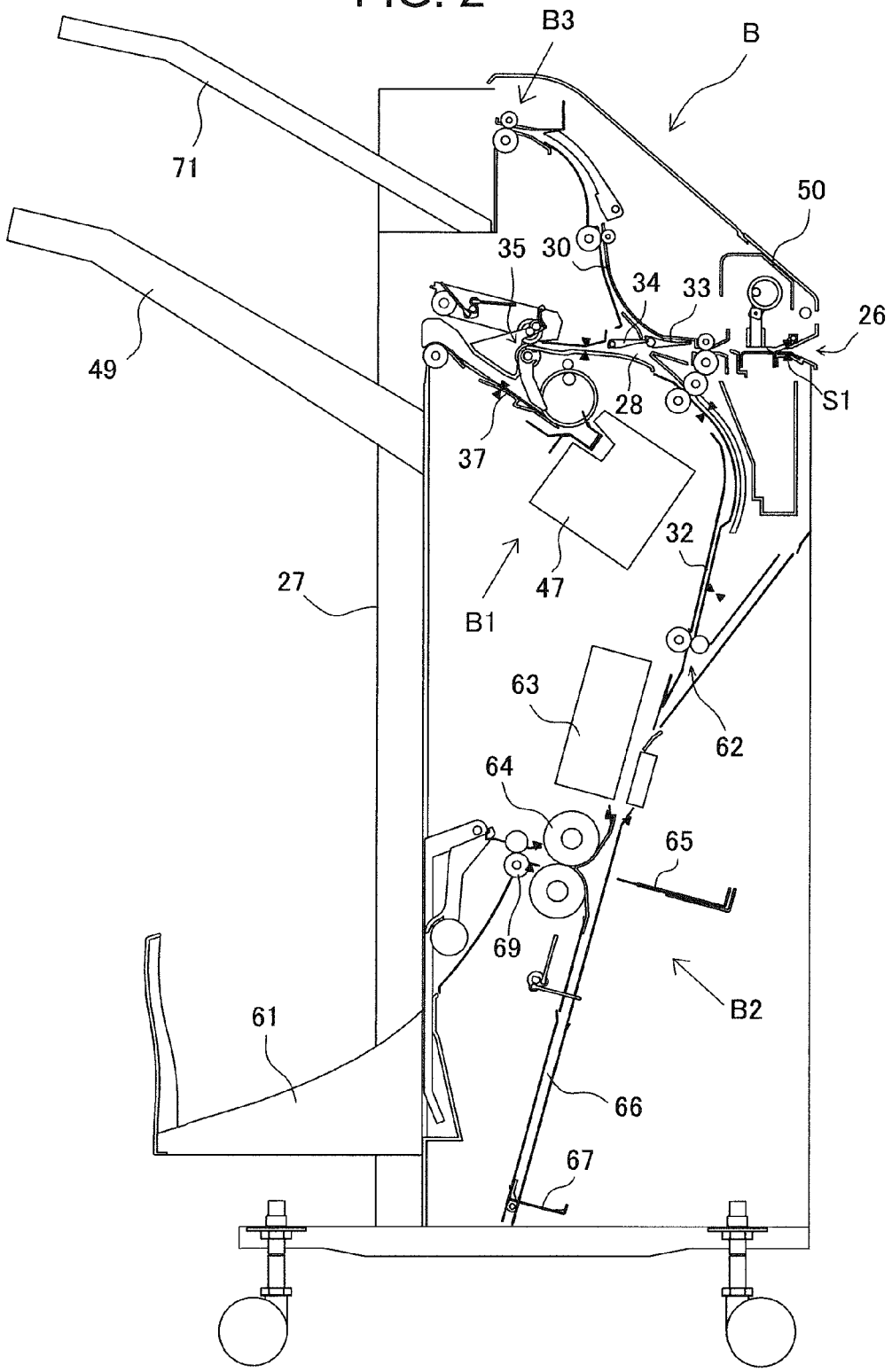
FIG. 2 is an explanatory view of a whole configuration of a sheet post-processing apparatus in the image forming system of FIG. 1.

FIG. 2 illustrates a detailed structure of the sheet post-processing apparatus B. The sheet post-processing apparatus B includes an introducing port 26 which is connected to the sheet discharging port 16 of the image forming apparatus A and stores sheets introduced through the introducing port 26 at a storage portion (a first stack tray 49, a second stack tray 61, and a third stack tray 71 which are described later) after a post-process is performed thereon.

In the post-processing apparatus B in the drawing, a sheet fed to a sheet introducing path 28 is conveyed to the first stack tray (hereinafter, called a first tray) 49 from the first processing portion B1, to the second stack tray (hereinafter, called a second tray) 61 from the second processing portion B2, or to the third stack tray (hereinafter, called a third tray) 71 from the third processing portion B3.

The first processing portion B1 is arranged at a path exit (sheet discharging port) 35 of the sheet introducing path 28. Here, sequentially-fed sheets are stored at the first tray (first storage portion, as the case may be) 49 after a binding process is performed thereon with the sheets being collated and stacked. The second processing portion B2 is arranged at a path exit (second switchback path end described later) 62 branched from the sheet introducing path 28. Here, a folding process is performed on sequentially-fed sheets and the sheets are stored at the second tray (second storage portion, as the case may be) 61 after a binding process is performed thereon with the sheets being collated and stacked. The third processing portion B3 is assembled to the sheet introducing path 28. Here, conveyed sheets are stored at the third tray (third storage portion, as the case may be) 71 after being offset by a predetermined amount in a perpendicular direction and sorted.

In the following, each structure will be described in detail.

[Apparatus Housing]

As illustrated in FIG. 2, the sheet post-processing apparatus B includes an apparatus housing 27, the sheet introducing path 28 which is embedded in the apparatus housing 27 as having the introducing port 26 and the sheet discharging port 35, the first to third processing portions B1, B2, B3 which perform a post-processing respectively on sheets fed from the sheet introducing path 28, and the first to third trays 49, 61, 71 which store sheets fed from the respective processing portions. The apparatus housing 27 in the drawing is arranged to have a height dimension from the installation face being approximately the same as the housing 1 of the image forming apparatus A which is located at the upstream side. Then, the sheet discharging port 16 of the image forming apparatus A and the introducing port 26 of the sheet post-processing apparatus B are connected.

The apparatus housing 27 illustrated in FIG. 2 is structured with an apparatus frame 70 and an external cover 73. The apparatus frame 70 forms a framework of a box-shaped apparatus as illustrated in the drawing. The apparatus frame 70 includes a front-side side frame 70*f* which is located at the front side in a state of FIG. 1, a rear-side side frame 70*r* which is located at the rear side, and stay members (connection reinforcement members) which connect both the side frames. The sheet introducing path 28, a processing tray 37, the stack tray 49, and the like which are described later are attached between the bilateral side frames.

The external cover 73 includes a front cover 73*f* which covers the front-side side frame 70*f* and a rear cover 73*r* which covers the rear-side side frame 70*r*. Not limited to the illustrated shape, naturally, the apparatus housing 27 may have an appropriate shape in design. Further, not limited to the structure having bilateral side frames and connection stays, the apparatus frame 70 may adopt a frame structure variously such as a monocoque structure.

[Sheet Introducing Path]

The sheet introducing path 28 is structured with a linear path which traverses the apparatus housing 27 approximately in the horizontal direction. The sheet introducing path 28 includes the introducing port 26 which is connected to the sheet discharging port (main body sheet discharging port) 16 of the image forming apparatus A, and the sheet discharging port 35 which is arranged at the opposite side to the introducing port 26 as traversing the apparatus. The sheet introducing path 28 is provided with a conveying roller 29 (a sheet conveying device such as a roller and a belt) which conveys a sheet from the introducing port 26 toward the sheet discharging port 35, a sheet discharging roller 36 (may be a belt as well) which is arranged at the sheet discharging port 35, an inlet sensor S1 which detects a leading end and a tailing end of a sheet to be introduced to the path, and a sheet discharging sensor S2 which detects a leading end and a tailing end of a sheet at the path sheet discharging port.

The sheet introducing path 28 is connected to the first processing portion B1 and the second processing portion B2 so that sheets are sorted and conveyed thereto from the introducing port 26. The second processing portion B2 is connected to the upstream side in the path sheet discharging direction and the first processing portion B1 is connected to the downstream side therein. The sheet introducing path 28 having an approximately linear shape is branched to convey a sheet from the introducing port 26 toward the second processing portion B2. Further, the sheet introducing path 28 is structured to guide a sheet from the introducing port 26 to the first processing portion B1 which is arranged at the downstream side of the path sheet discharging port 35.

Further, a third sheet discharging path (printout sheet discharging path) 30 which guides a sheet on which a post-process is not performed at the first processing portion B1 or the second processing portion B2 to the third tray 71 is connected to the sheet introducing path 28, so that a sheet is guided to the third tray (overflow tray) 71. The third processing portion B3 is arranged at the sheet introducing path 28. The third processing portion B3 performs jog sorting to sort a sheet to be conveyed on the path by offsetting the sheet in a direction perpendicular to a sheet discharging direction. That is, the third processing portion B3 is arranged at the sheet introducing path 28 and sheets jog-sorted at the third processing portion B3 are stored at the third tray 71.

As illustrated in FIG. 2, at the sheet introducing path 28, the third sheet discharging path 30, a second sheet discharging path 32, and a first sheet discharging path 31 are arranged in the order thereof from the introducing port 26 to the downstream side. A first path switching device 33 and a second path switching device 34 are arranged as illustrated in FIG. 2. The second sheet discharging path 32 and the first sheet discharging path 31 are structured as a switchback path which guides a sheet to each processing portion as reversing the sheet conveying direction.

The third sheet discharging path 30 guides sheets fed from the introducing port 26 to the third tray 71, the second sheet discharging path 32 guides sheets fed from the introducing port 26 to the second tray 61, and the first sheet discharging path 31 guides sheets fed from the introducing port 26 to the first tray 49. The third processing portion B3 performs a jog sorting process on sheets at the path to be guided to the third tray 71, the second processing portion B2 performs a bookbinding process on sheets to be guided to the second tray 61, and the first processing portion B1 performs a binding process on sheets to be guided to the first tray 49.

The first path switching device 33 is structured with a flapper guide which changes a sheet conveying direction and is connected to a driving device such as an electromagnetic solenoid and a miniature motor (not illustrated). At the first path switching device 33, a sheet fed from the introducing port 26 is selected to be guided to the third sheet discharging path 30 or to the first and second sheet discharging paths 31, 32.

At the second path switching device 34, a sheet fed from the introducing port 26 is selected to be guided to the second processing portion B2 or the first processing portion B1 at the downstream side thereof. A driving device (not illustrated) is connected to the second path switching device 34 as well. Further, a punch unit 50 which forms a punch hole at an introduced sheet is arranged at the sheet introducing path 28.

[First Processing Portion]

The first processing portion B1 arranged at the downstream side of the sheet introducing path 28 is structured with the processing tray 37 which collates and stacks sheets fed from the sheet discharging port 35 and a binding processing mechanism which performs a binding process on a stacked sheet bundle. As illustrated in FIG. 2, a step is formed at the sheet discharging port 35 of the sheet introducing path 28 and the processing tray 37 is arranged therebelow. The first sheet discharging path (first switchback path) 31 which guides a sheet from the sheet discharging port 35 as reversing a conveying direction is formed between the sheet discharging port 35 and the processing tray 37.

A sheet introducing mechanism which introduces a sheet from the sheet discharging port 35 onto the processing tray 37 is arranged between the sheet discharging port 35 and the processing tray 37. A positioning mechanism which positions sheets at a predetermined binding position and a sheet bundle discharging mechanism which discharges a bound sheet bundle to the first tray 49 at the downstream side are arranged at the processing tray 37. Each configuration is described later.

Here, the processing tray 37 illustrated in FIG. 2 bridge-supports a sheet fed from the sheet discharging port 35 between the processing tray 37 and the first tray 49 at the downstream side. That is, a sheet fed from the sheet discharging port 35 is to be bridge-supported with the leading end thereof being on the upmost sheet on the first tray 49 at the downstream side and the tailing end thereof being on the processing tray 37.

[Second Processing Portion]

A second sheet discharging path (second switchback path) 32 is branched from and connected to the upstream side of the first sheet discharging path (first switchback path) 31 at the sheet introducing path 28 to guide a sheet to the second processing portion B2. At the second processing portion B2, sheets fed from the sheet introducing path 28 are collated and stacked, and then, an inward-fold processing (hereinafter, called a magazine finishing) is performed on the sheets as performing a binding process on the center part thereof. The second tray 61 is arranged at the downstream side of the second processing portion B2 to store a bookbinding-processed sheet bundle.

The second processing portion B2 includes a guide member 66 which stacks sheets into a bundle shape, a regulating stopper (in the drawing, a leading end regulating stopper) 67 which performs positioning of sheets at a predetermined position on the guide member 66, a stapling unit (center-binding stapling unit) 63 which performs a binding process at the center part of the sheets which are positioned by the regulating stopper 67, and a fold-processing mechanism (a pair of folding rollers 64 and a folding blade 65) which folds a sheet bundle at the center part after the binding process is performed.

As disclosed in Japanese Patent Application Laid-open No. 2008-184324, Japanese Patent Application Laid-open No. 2009-051644, and the like, the center-binding stapling unit 63 adopts a mechanism which performs a binding process while a sheet bundle is moved along the sheet center part (line) with the sheet bundle nipped by a head unit and an anvil unit.

Further, as illustrated in FIG. 2, the fold-processing mechanism has a structure to perform folding with rolling of the pair of folding rollers 64 after a folding line part of a sheet bundle is inserted by the folding blade 65 between the pair of folding rollers 64 which are mutually press-contacted. Such a mechanism is also disclosed in Japanese Patent Application Laid-open No. 2008-184324, Japanese Patent Application Laid-open No. 2009-051644, and the like.

In the drawing, the first processing portion B1 and the sheet introducing path 28 are arranged approximately in the horizontal direction, the second sheet discharging path 32 which guides sheets to the second processing portion B2 is arranged in the vertical direction, and the guide member 66 which collates and stacks sheets is arranged approximately in the vertical direction. As described above, the sheet introducing path 28 is arranged in a direction of traversing the apparatus housing 27 and the second sheet discharging path 32 and the second processing portion B2 are arranged in the vertical direction, so that the apparatus can be slimmed.

The second tray 61 is arranged at the downstream side of the second processing portion B2 to store a sheet bundle which is folded into a magazine shape. In the drawing, the second tray 61 is arranged below the first tray 49. In view of that a frequency in use of the first tray 49 is higher than a frequency in use of the second tray 61, the first tray 49 is arranged at a height position at which sheets are easily taken out from the first tray 49.

[Third Processing Portion]

The third sheet discharging path 30 is arranged at the sheet introducing path 28 at the upstream side of the first sheet discharging path 31 and the second sheet discharging path 32, so that a sheet is guided from the introducing port 26 to the third tray 71. Further, a roller shifting mechanism (not illustrated) which offsets a fed sheet by a predetermined amount in a perpendicular direction is arranged at the path (the sheet introducing path 28 or the third sheet discharging path 30) for guiding the sheet from the introducing port 26 to the third tray 71.

Then, sheets are stored onto the third tray 71 while the sheets to be discharged from the introducing port 26 to the third tray 71 are shifted (offset) in the perpendicular direction so that the sheets are sorted for each bundle. Since a variety of mechanisms are known as such a jog sorting mechanism, description thereof is skipped.

[Structure of Manual Setting Portion]

A sheet processing mechanism portion which stores sheets at a stack tray 49 after guiding the sheets from the sheet introducing path 28 to the processing tray 37 and performing a post-process on the sheets, and a manual setting portion 77 for performing a binding process while an externally-prepared sheet bundle is inserted to the external cover 73 are arranged at the apparatus housing 27. When a binding processing mechanism is arranged at the exterior of the sheet post-processing apparatus B, the manual setting portion 77 is convenient for an operator to collate, for example, image-read document sheets and performing a binding process thereon. Accordingly, a sheet bundle collated by an operator is arranged at a part of a casing and a mechanism which performs a binding process with a built-in stapling unit or another binding processing unit is arranged therein.

The manual setting portion 77 arranged for the above-mentioned purpose includes a slit-shaped opening 77*a*, a setting face 77*b*, and a regulating face 77*c*. Further, a binding processing unit which performs a binding process on a sheet bundle set on the setting face is arranged in the apparatus.

Figure 4:
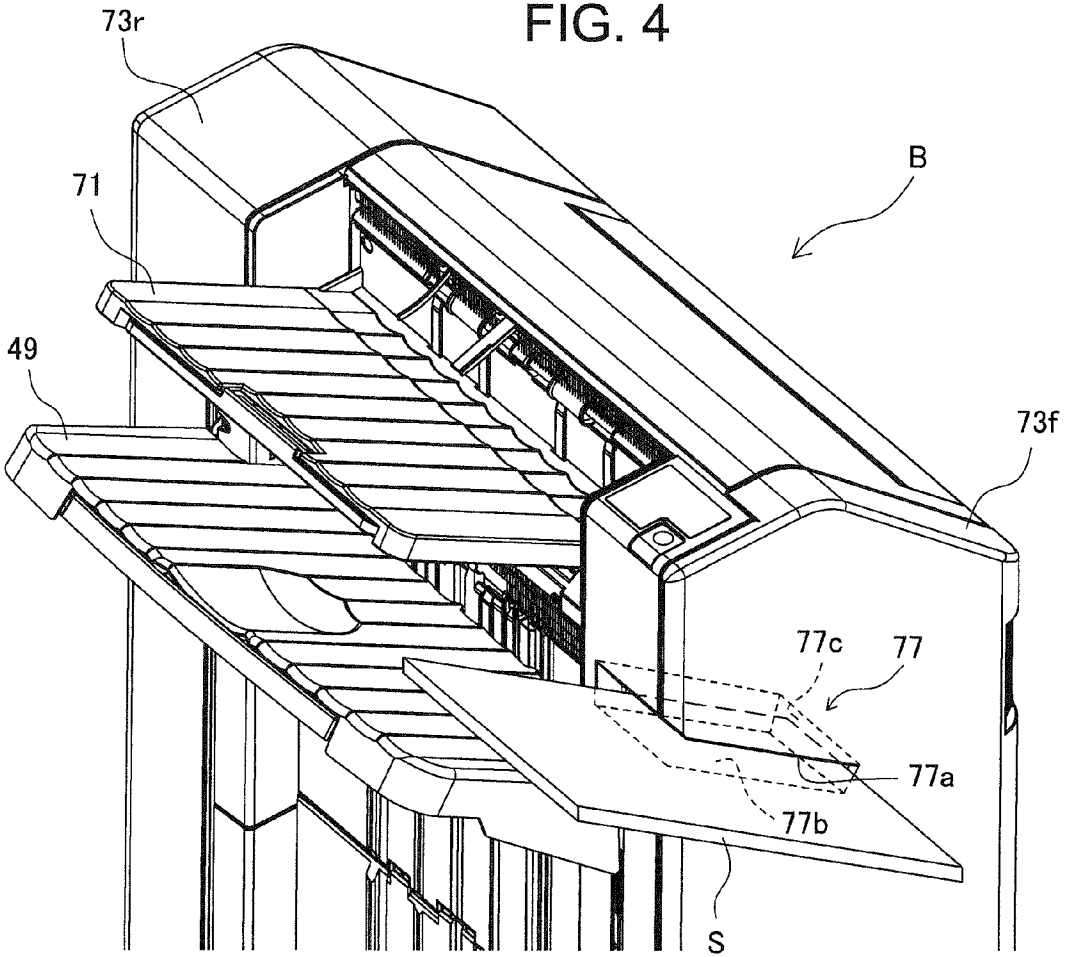
FIG. 4 is a perspective view of a manual setting portion in the apparatus of FIG. 2.
Figure 5A:
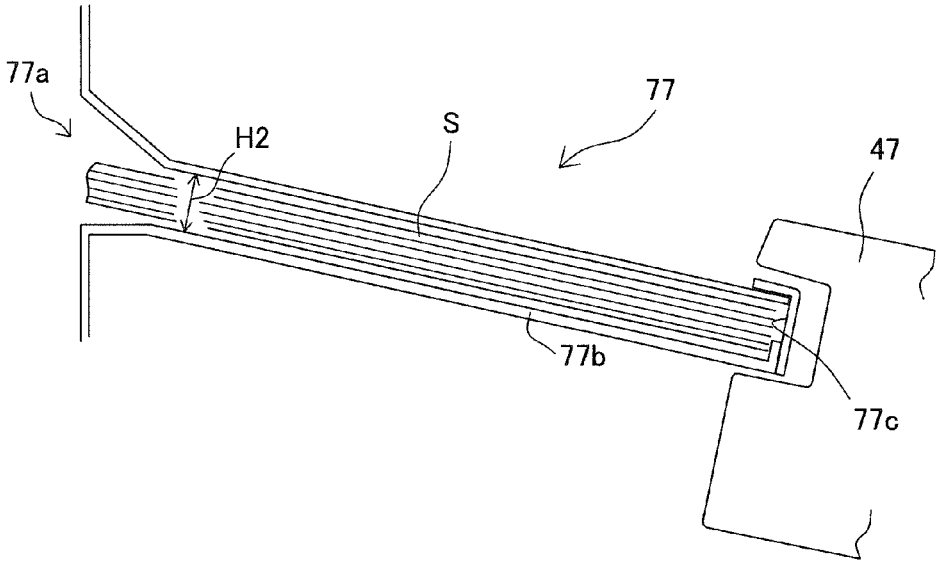
FIG. 5A illustrates a first embodiment of the manual setting portion and FIG. 5B is a view illustrating an arrangement relation between a sheet placement face of a processing tray and a setting face.
Figure 5B:
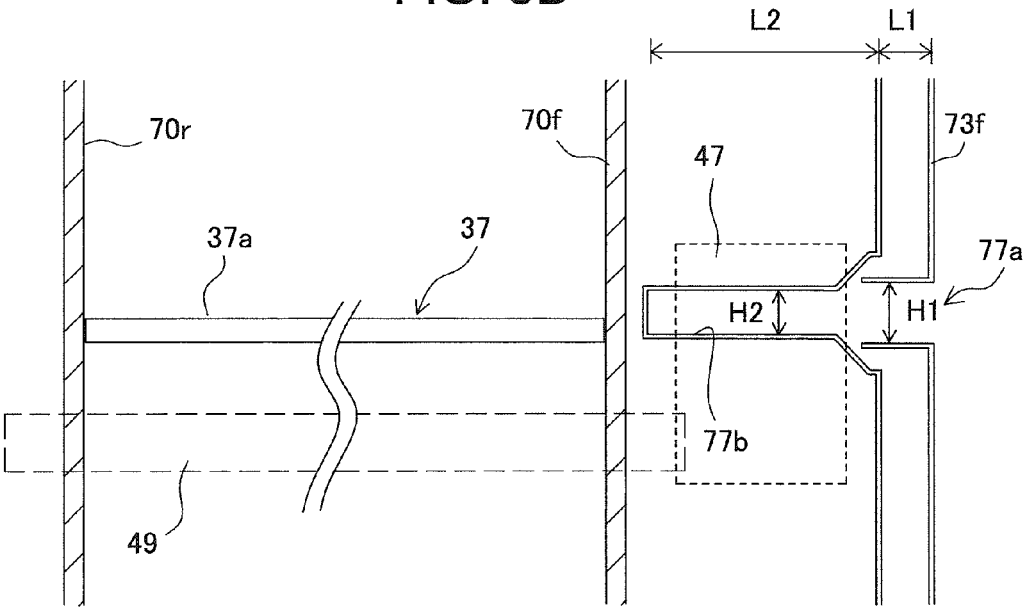

As illustrated in FIG. 4, the slit-shaped opening 77*a* is arranged at the front cover 73*f*, so that a sheet bundle S is inserted thereto from the outside. In the illustrated apparatus, the slit-shaped opening 77*a* is arranged at a position to support a sheet bundle on the same plane as the processing tray 37 described with reference to FIG. 2 as being mutually adjacent thereto. That is, as illustrated in FIG. 5B, the setting face 77*b* is arranged approximately on the same plane at a position adjacent to the sheet placement face 37*a* of the processing tray 37 via the front-side side frame 70*f*.

According to the above arrangement, a binding process is performed on a manually-set sheet bundle while the later-described binding unit (stapling unit) 47 capable of being moved along an end edge of the processing tray 37 is moved to the setting face 77*b* which is arranged at a position adjacent to the processing tray 37. Thus, the setting face 77*b* is arranged to form the same plane with the sheet placement face 47*a* of the processing tray 37.

Figure 7:
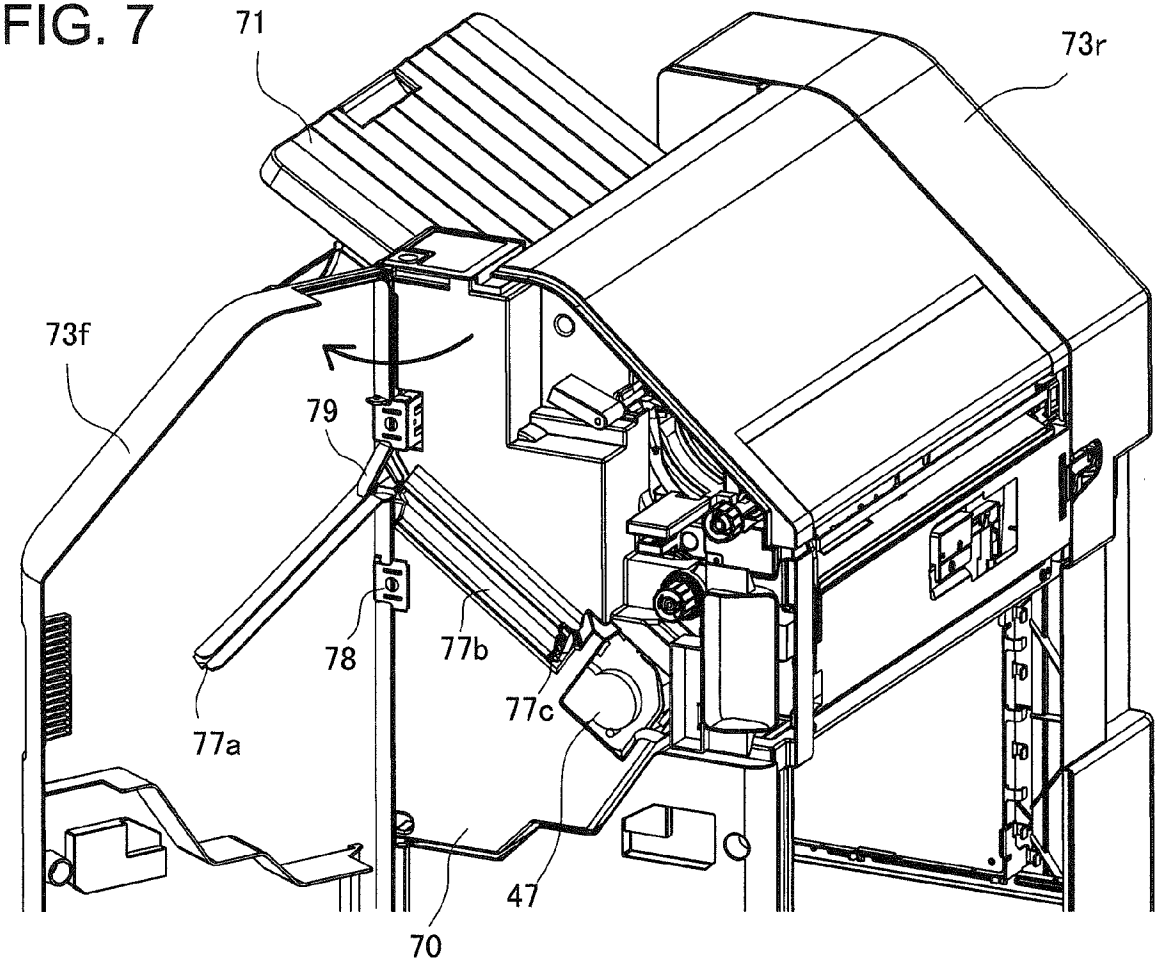
FIG. 7 is a view illustrating a state that an open-close cover of the apparatus of FIG. 2 is opened.

The slit-shaped opening 77*a* is arranged at the front cover 73*f* so that a sheet bundle can be inserted onto the setting face 77*b* (on the same plane as the processing tray 37). The whole or a part of the front cover 73*f* at which the slit-shaped opening 77*a* is formed is hinge-connected to the apparatus frame 70 as being capable of being opened and closed. An opened state thereof is illustrated in FIG. 7. The front-side side frame 70*f* is formed as a frame plate. The front cover 73*f* is attached to the front-side side frame 70*f* with a hinge 78 in an openable and closable manner. An open-close switch (a mechanical switch, a photo-switch (not illustrate)) is arranged at a connection portion which is openable and closable to detect whether the front cover 73*f* is in an opened state or a closed state. Here, a later-described controller 95 supplies or discontinues power to the stapling unit in accordance with an ON/OFF signal from the open-close switch.

[First Embodiment of Manual Setting Portion]

A first embodiment of the manual setting portion 77 will be described with reference to FIGS. 5A-5B. The manual setting portion 77 which performs a binding process on a sheet bundle inserted from the outside as being arranged at the external cover 73 of the sheet post-processing apparatus B includes the slit-shaped opening 77*a*, the setting face 77*b*, and the regulating face 77*c*. The slit-shaped opening 77*a* is arranged at a part of the external cover 73 as an opening through which a sheet bundle can be inserted from the outside. That is, the slit-shaped opening 77*a* is arranged to be capable of receiving a sheet bundle from the outside. The setting face 77*b* is formed as a plate member on which a lower face of a sheet bundle inserted through the slit-shaped opening 77*a* is placed as a sheet supporting face on the same plane as the sheet placement face 37*a* of the processing tray 37. The regulating face 77*c* is formed as a wall face which performs regulation with abutting against an end edge of a sheet bundle inserted along the setting face 77*b*.

That is, a sheet bundle S which is manually inserted through the slit-shaped opening 77*a* is inserted to a binding position along the setting face 77*b* and is regulated with an end face thereof being abutted to the regulating face 77*c* at the binding position. Thus, the sheet bundle S which is inserted from the outside has the lower face thereof supported by the setting face 77*b* and the end face thereof abutted to and regulated by the regulating face 77*c* so as to be positioned at the predetermined binding position. The stapling unit (binding unit) 47 is arranged at the inner side of the setting face 77*b* and the regulating face 77*c*. In the illustrated apparatus, the binding unit 47 is supported by a guide rail to be movable between the binding position at the processing tray 37 and the binding position at the setting face 77*b* and is moved by a drive mechanism which includes a shifting motor.

The slit-shaped opening 77*a* is formed at the front cover 73*f*. The slit-shaped opening 77*a* has an opening height H1 (a dimension in a sheet bundle thickness direction) as illustrated in FIG. 5B and includes a flange 79. Here, the slit-shaped opening 77*a* is integrally formed with the front cover 73*f* in resin-molding. The setting face 77*b* is formed as a plate member which is attached to the apparatus frame (the front-side side frame 70*f* in the drawing) and includes a supporting face which supports a lower face of a sheet bundle. The regulating face 77*c* may be attached to the apparatus frame similarly to the setting face 77*b* or may be attached to the apparatus frame via another member. Further, the binding unit 47 is supported to be moved along first and second travel rails 53, 54 which are arranged at the apparatus frame 70.

As described above, in the present invention, the slit-shaped opening 77*a* is formed at the front cover 73*f*, the setting face 77*b* and the regulating face 77*c* are attached to the apparatus frame 70, and the front cover 73*f* is attached to the apparatus frame 70 in an openable and closable manner. Then, a binding process is performed after the binding unit 47 slidably arranged at the apparatus frame 70 is moved to a manual binding position Mp set at the setting face 77*b*. Further, staples (a staple cartridge) are replenished while the binding unit 47 is at the manual binding position Mp or in a state of being moved from the manual binding position Mp to the front side by a predetermined distance.

Thus, the slit-shaped opening 77*a* is arranged at the front cover 73*f* which is openable and closable in resin molding or the like and the setting face 77*b* and the regulating face 77*c* are arranged at the same apparatus frame 70 as the binding unit 47. Accordingly, even when positional deviation occurs at the front cover 73*f*, a sheet bundle on which a binding process is to be performed is positioned by the setting face 77*b* and the regulating face 77*c*.

In the illustrated embodiment, an opening height H1 and an opening width L1 of the slit-shaped opening 77*a* are set to satisfy "H1>H2" and "L2>L1". Here, H2 and L2 denote a bundle thickness regulation height formed above the setting face 77*b* and a sheet supporting face width, respectively. That is, the opening height H1 of the slit-shaped opening 77*a* is set larger than the bundle thickness regulation height H2 formed above the setting face 77*b*.

According to the above, sheets inserted through the slit-shaped opening 77*a* are regulated in height at the setting face 77*b*. Although a sheet bundle having a thickness being larger than an allowable thickness passes through the slit-shaped opening 77*a*, the sheet bundle is blocked at the setting face 77*b* from being further inserted. Further, the sheet supporting face width L2 of the setting face 77*b* is set larger than the opening width L1 of the front cover 73*f*. Further, an inclined guiding face for guiding a sheet bundle S to the setting face 77*b* is arranged at the flange 79 at the slit-shaped opening 77*a*. A leading end of the sheet bundle S is guided to the setting face 77*b* along the inclined guiding face.

[Second Embodiment of Manual Setting Portion]

Figure 6A:
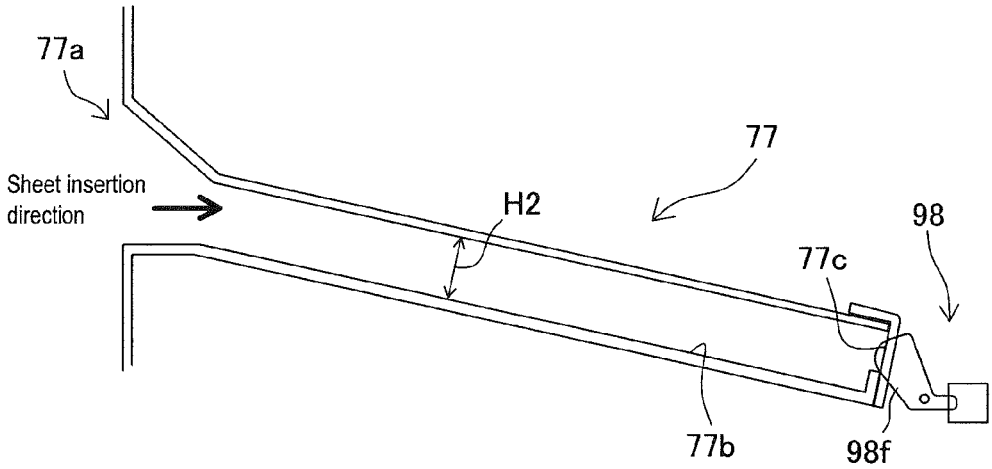
FIG. 6A is a side sectional view of a second embodiment of the manual setting portion in the apparatus of FIG. 2
Figure 6B:
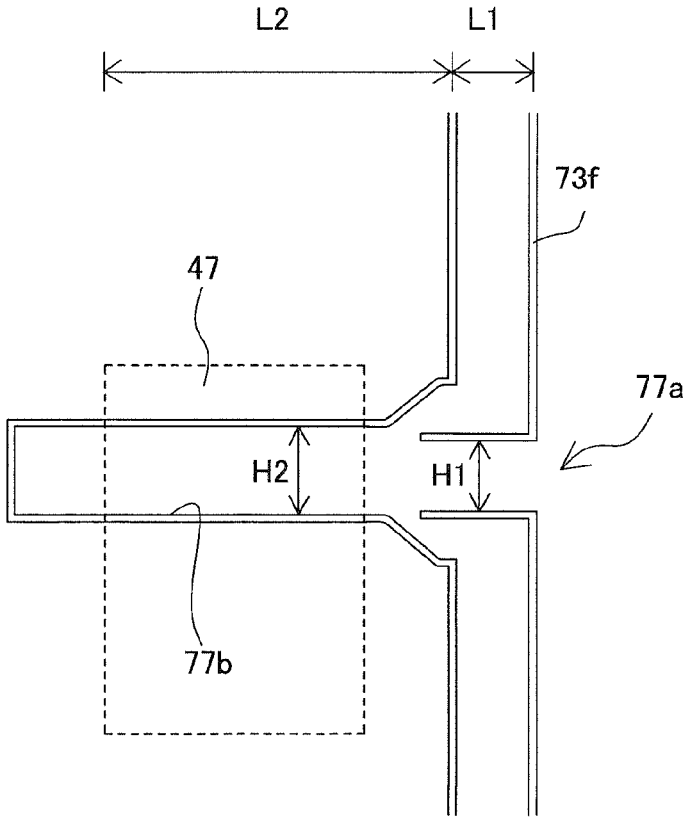
FIG. 6B is a front sectional view thereof.

A second embodiment of the manual setting portion 77 will be described with reference to FIGS. 6A-6B. The same reference is given to the same element as in the first embodiment and description thereof will not be repeated. As illustrated in FIGS. 6A-6B, the opening height H1 of the slit-shaped opening 77*a* and the sheet bundle regulation height H2 above the setting face 77*b* are set to satisfy "H1<H2". The rest of the structure is the same as the first embodiment. According to the above, since an opening having a minimum required size is formed at the external cover 73, foreign matters are prevented from entering to the inside carelessly.

[Binding Process Operation at Manual Setting Portion]

Description is provided on a binding process operation in the first embodiment and the second embodiment described above. In an operation mode in which a binding process is not performed at the processing tray 37 (i.e., post-processing at the second processing portion B2 or the third processing portion B3), the later-described controller 95 causes the binding unit 47 to wait at the manual binding position Mp or the vicinity thereof. In the illustrated apparatus, a home position of the binding unit 47 is set at the manual binding position Mp.

Further, a sheet bundle detecting device 98 is arranged at the regulating face 77*c* as illustrated in FIGS. 6A-6B. In the illustrated mechanism, a flag member 98*f* protruded from the regulating face 77*c* in a sheet insertion direction is detected by a photo sensor. Thus, the sheet bundle detecting device 98 determines whether or not a sheet bundle S exists on the setting face 77*b* in a state of being abutted to the regulating face 77*c*. Then, when the sheet bundle detecting device 98 is in an ON state as detecting the sheet bundle S, a binding process execution signal is transmitted to the binding unit 47.

[Structure of First Processing Portion]

Description is provided on the respective structures of a sheet introducing mechanism, a sheet positioning mechanism, a binding processing mechanism, and the sheet bundle discharging mechanism of the first processing portion B1.

[Sheet Introducing Mechanism]

Figure 3:
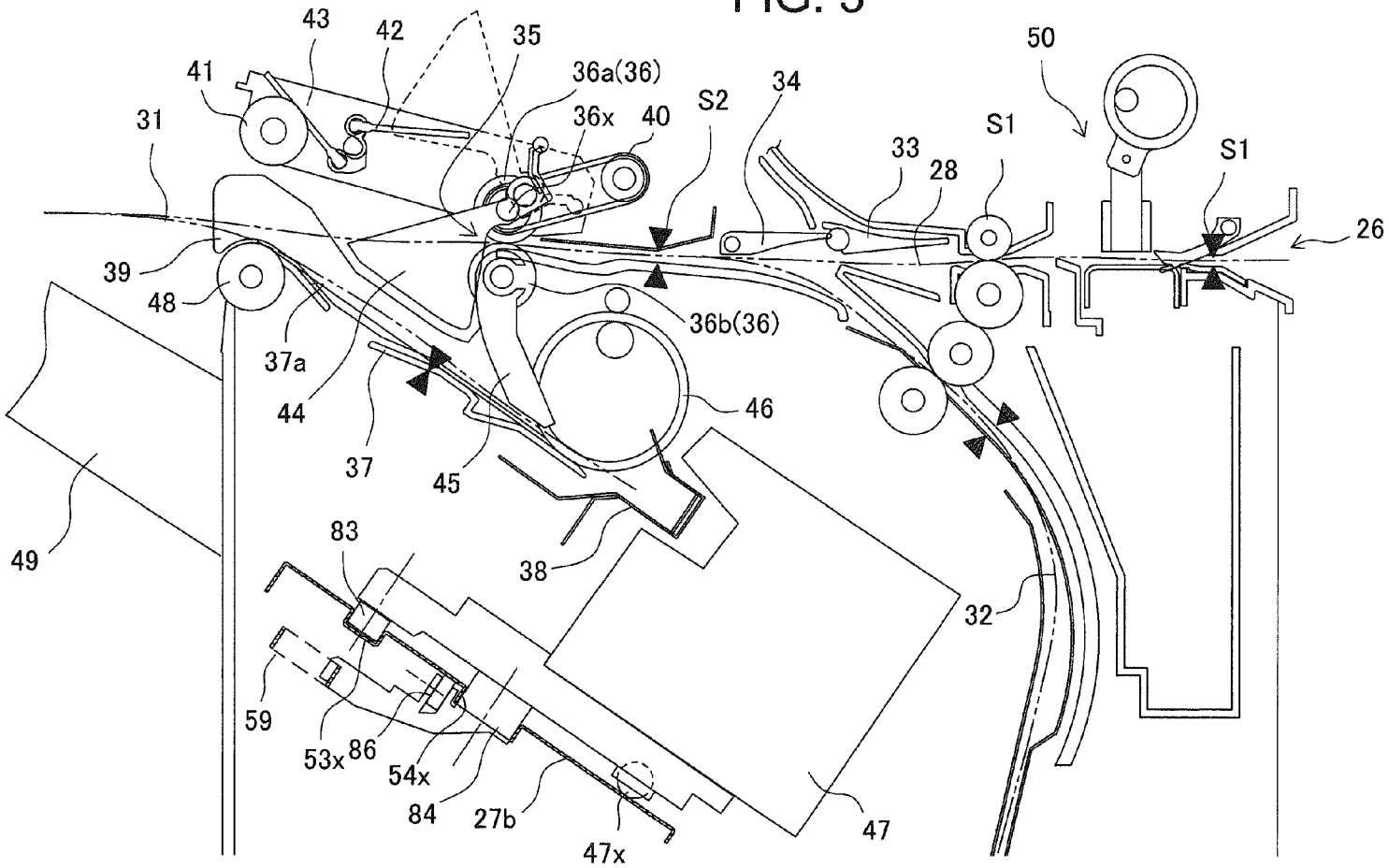
FIG. 3 is an enlarged view of a main part of a path in the apparatus of FIG. 2.

As illustrated in FIG. 3, a reverse conveying mechanism 41, 42 which performs switchback conveying on a sheet from the sheet discharging port 35 in an opposite direction to the sheet discharging direction, a guiding mechanism (sheet guiding member) 44 which guides a sheet to the tray side, and a raking rotor 46 which guides a sheet to a leading end regulating device are arranged between the sheet discharging port 35 and the processing tray 37.

The reverse conveying mechanism includes a lifting-lowering roller 41 which is moved upward and downward between an operating position to be engaged with a sheet to be introduced onto the processing tray 37 and a waiting position to be separated therefrom, and a paddle rotor 42 which conveys a sheet in the direction opposite to the sheet discharging direction. The lifting-lowering roller 41 and the paddle rotor 42 are attached to a swing bracket 43.

The swing bracket 43 is arranged at the apparatus frame 70 swingably about a rotating shaft 36*x* (in the drawing, a sheet discharging roller shaft). A rotating shaft of the lifting-lowering roller 41 and a rotating shaft of the paddle rotor 42 are bearing-supported by the swing bracket 43. A lifting-lowering motor (not illustrated) is connected to the swing bracket 43, so that the lifting-lowering roller 41 and the paddle rotor 42 which are mounted thereon are moved upward and downward between the operating position to be engaged with a sheet and the waiting position to be separated therefrom.

Further, a drive motor (not illustrated) is connected to each of the lifting-lowering roller 41 and the paddle rotor 42 to transmit driving so that the lifting-lowering roller 41 is rotated in forward and reverse directions and the paddle rotor 42 is rotated in a reverse direction (a direction opposite to the sheet discharging direction). Further, a driven roller 48 which is mutually pressure-contacted to the lifting-lowering roller 41 is arranged at the processing tray 37, so that a sheet or bundle-shaped sheets is nipped and conveyed to the downstream side.

The guiding mechanism which guides a tailing end of a sheet introduced onto the processing tray 37 toward a regulating device 38 is arranged between the lifting-lowering roller 41 and the later-described raking rotor 46. As illustrated in FIG. 3, the guiding mechanism is structured with the sheet guiding member 44 which is moved upward and downward between a state illustrated in a dotted line and a state illustrated in a solid line. The sheet guiding member 44 retracts to the dotted-line position when a sheet is discharged from the sheet discharging port 35. After a tailing end of the sheet passes through the sheet discharging port 35, the sheet guiding member 44 guides the sheet tailing end onto the processing tray 37. A driving mechanism (not illustrated) is connected to the sheet guiding member 44, so that the sheet guiding member 44 is moved upward and downward in accordance with timing of guiding the sheet tailing end from the sheet discharging port 35 onto the processing tray 37.

[Sheet Positioning Mechanism]

The positioning mechanism 38, 39 which positions sheets at a predetermined binding position is arranged at the processing tray 37. As illustrated in the drawing, the positioning mechanism is structured with a sheet end regulating device 38 which performs regulation with abutting against a sheet tailing end and a side edge aligning device 39 which positions a sheet side edge at a reference position (center reference, side reference).

As illustrated in FIG. 3, the sheet end regulating device 38 is structured with a stopper member which performs regulation with abutting against a sheet tailing end. The side edge aligning member 39 is described later with reference to FIG. 9. In the illustrated apparatus, a sheet is discharged from the sheet introducing path 28 in center reference. Then, in accordance with a binding mode, the sheet is positioned in center reference as well or side reference.

[Side Edge Aligning Device]

Figure 9:
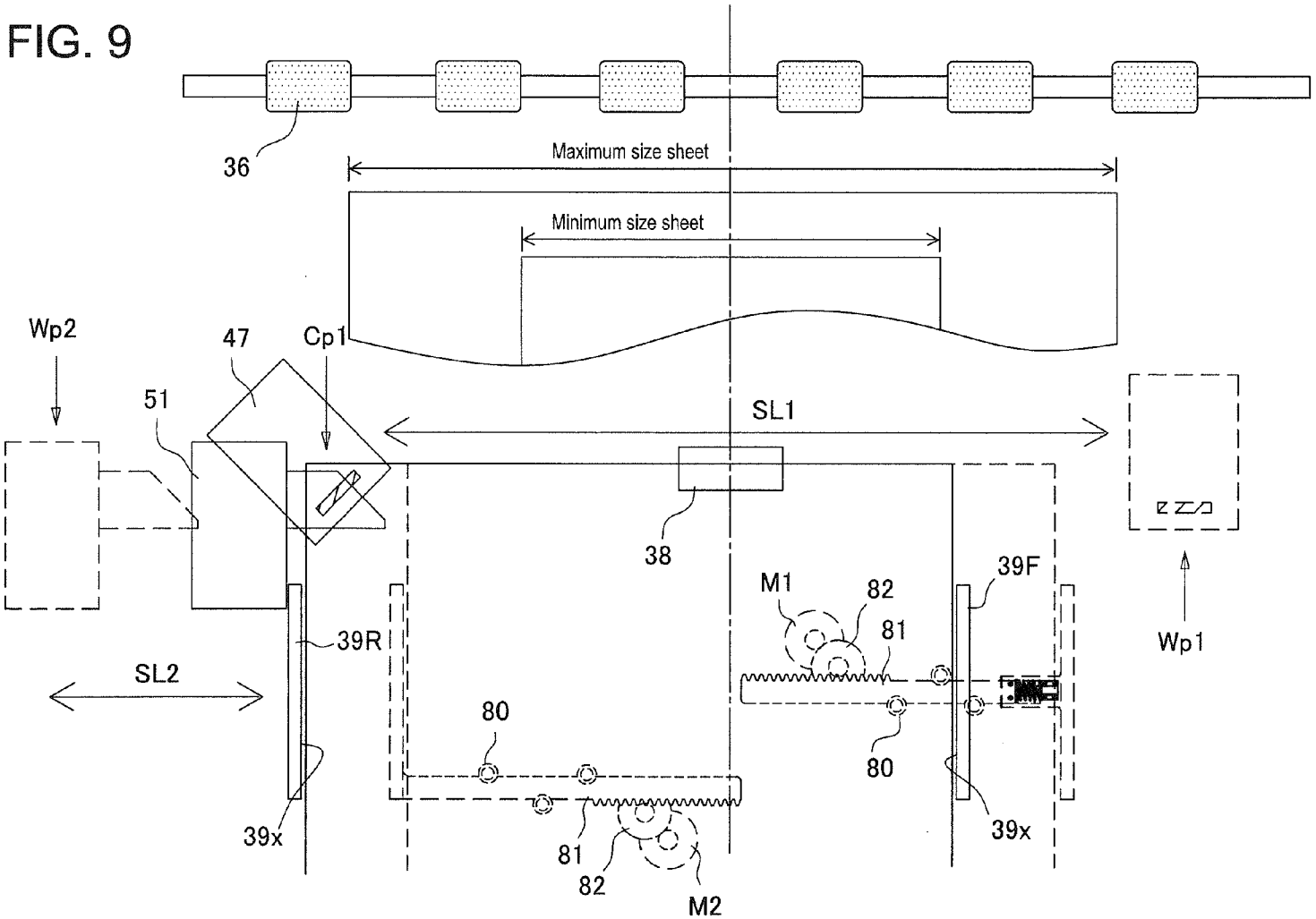
FIG. 9 is an explanatory view illustrating an arrangement relation among alignment positions and the stapling unit in the apparatus of FIG. 2.

As illustrated in FIG. 9, side edge aligning plates 39F, 39R are protruded upward from the sheet placement face 37*a* of the processing tray 37 and arranged as a right-left pair to be mutually opposed, each having a regulating face 39*x* which is engaged with a side edge of a sheet. The pair of side edge aligning devices 39 are arranged at the processing tray 37 to be capable of reciprocating by a predetermined stroke. The stroke is set in accordance with a size difference between a maximum size sheet and a minimum size sheet and an offset amount of rightward or leftward moving (offset conveying) of an aligned sheet bundle.

That is, the movement stroke of the right-left side edge aligning devices 39F, 39R is set in accordance with a movement amount for aligning different size sheets and the offset amount of the aligned sheet bundle. As offset movement of the side edge aligning plates 39F, 39R, a sheet discharged in center reference is moved by a predetermined amount rightward for right corner binding and leftward for left corner binding. The offset movement is performed one by one (for each introduced sheet) each time when a sheet is introduced to the processing tray 37 or performed for each bundle to be bound after sheets are aligned in a bundle shape.

As illustrated in FIG. 9, the side edge aligning device 39 is structured with the right side edge aligning member 39F (apparatus front side) and the left side edge aligning member 39R (apparatus rear side). Both the side edge aligning members are supported by the processing tray 37 so that the regulating faces 39*x* which are engaged with side edges of a sheet are mutually moved in a closing direction or a separating direction. Slit grooves (not illustrated) are formed to penetrate the processing tray 37. The side edge aligning devices 39 each having the regulating face 39*x* which is engaged with a sheet side edge are fitted to the slits toward the upper face of the processing tray 37 in a slidable manner.

The respective side edge aligning members 39F, 39R are slidably supported at the back face of the processing tray 37 with a plurality of guide rollers 80 (or may be a rail member) and a rack 81 is integrally arranged at each of the side edge aligning members 39F, 39R. Aligning motors M1, M2 are connected to the right-left racks 81 respectively via a pinion 82. The right-left aligning motors M1, M2 are structured with stepping motors. Here, positions of the right-left side edge aligning members 39F, 39R are detected by a position sensor (not illustrated). The respective side edge aligning members 39F, 39R are structured to be capable of being moved by a specified movement amount in both right and left directions with reference to the detection values.

Here, without adopting the illustrated rack-and-pinion mechanism, it is also possible to adopt a structure that the side edge aligning members 39F, 39R are fixed to a timing belt which is connected via a pulley to a motor for causing the timing belt to reciprocate to the right and left.

With the abovementioned structure, the later-described controller 95 causes the right-left side edge aligning members 39F, 39R to wait at predetermined waiting positions (positions to be mutually apart by a sheet width+$\alpha$) based on sheet size information provided from the image forming apparatus A and the like. In multi-binding operation, the aligning operation is started at timing when a tailing end of a sheet is abutted to the tailing end regulating device 38 after the sheet is introduced onto the processing tray 37. In the aligning operation, the right-left aligning motors M1, M2 are rotated in opposite directions (closing directions) by the same amount.

Sheets introduced onto the processing tray 37 are positioned with reference to the sheet center and stacked into a bundle shape. According to repetition of the introducing operation and the aligning operation of sheets, the sheets are collated and stacked into a bundle shape on the processing tray 37. Here, a sheet having a different size is positioned in center reference as well. In corner binding operation, the aligning operation is started at timing when a tailing end of a sheet is abutted to the tailing end regulating device 38 after the sheet is introduced onto the processing tray 37. In the aligning operation, a movement amount of the aligning plate at the binding position side is set different from a movement amount of the aligning plate at the side opposite to the binding position. The movement amounts are set so that the sheet corner is located at a previously-set binding position.

[Binding Processing Mechanism]

Binding processing mechanisms 47, 51 which perform a binding process on a sheet bundle stacked on the sheet placement face 37*a* are arranged at the processing tray 37. Sheets are positioned at a predetermined binding position on the sheet placement face 37*a* of the processing tray 37 by the positioning mechanism (the sheet end regulating device 38 and the side edge aligning device 39). The binding processing mechanisms 47, 51 are structured so that a first binding unit 47 (a first binding device being the stapling unit, as the case may be) which performs a staple binding using a staple on a sheet bundle and a second binding unit 51 (a second binding device being an eco-binding unit, as the case may be) which performs a non-staple binding are arranged contrary at the binding position.

As illustrated in FIG. 2, the binding processing mechanisms 47, 51 which perform a binding process on a tailing end of sheets introduced from the sheet discharging port 35 are arranged at the processing tray 37. The binding processing mechanisms include the stapling unit (first binding unit) 47 capable of being moved along the tailing end of the sheet placement face 37*a* of the processing tray 37 and the eco-binding unit (second binding unit) 51, as illustrated in FIG. 8.

Figure 8:
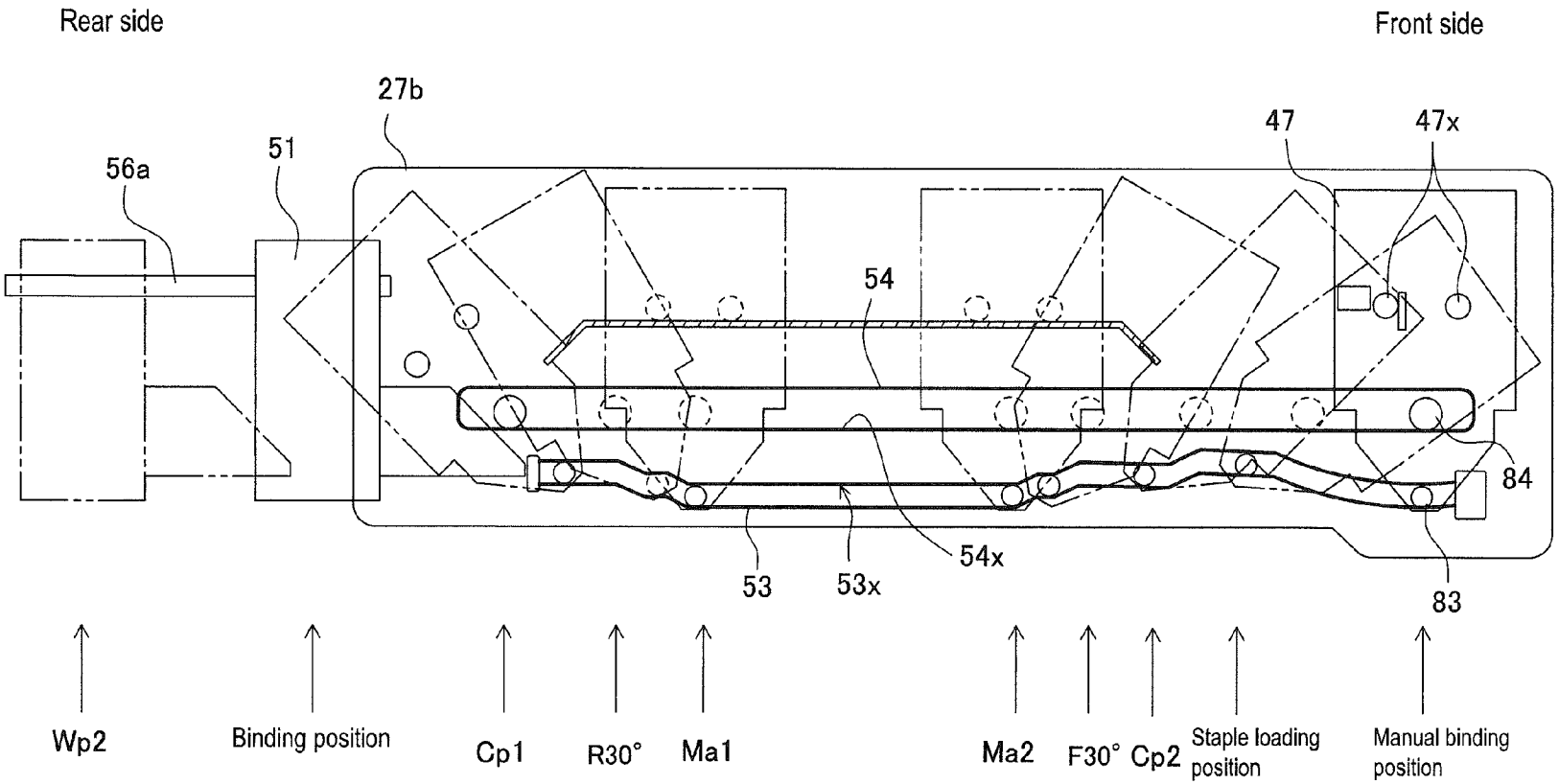
FIG. 8 illustrates a movement trajectory of a stapling unit and an eco-binding device.

FIG. 8 illustrates the stapling unit (first binding unit) 47 and the eco-binding unit (second binding unit) 51 which are arranged at the processing tray 37. In the illustrated apparatus, a binding position Cp1 is set at a sheet corner located at the upper-left side in the drawing. The first binding unit 47 and the second binding unit 51 are moved contrary to the binding position Cp1.

The first binding unit 47 is moved by a predetermined stroke SL1 along the first travel rail 53 and a second travel rail 54 which are formed at the apparatus frame 27*b*. Similarly, the second binding unit 51 is moved by a predetermined stroke SL2 along a first guide rod 56*a* and a second guide rod 56*b* (see FIGS. 12A-12C) which are arranged at the apparatus frame 57.

FIG. 9 illustrates a sheet introduced onto the processing tray 37 and movement strokes of the first and second binding units 47, 51. Sheets having different sizes (between the maximum size sheet and the minimum size sheet) are introduced onto the processing tray 37 in center reference. The sheet is aligned by the right-left pair of side edge aligning members 39F, 39R (so that sheets having different sizes are matched) with reference to a sheet side edge at the binding side (left side edge in FIG. 9). The right-left aligning members 39F, 39R are connected respectively to the separate drive motors M1, M2. The later-described controller 95 sets movement amount of the right-left aligning members 39F, 39R in accordance with sheet sizes.

In a binding process other than the corner binding process, for example, in a later-described multi-binding process, the later-described controller 95 causes sheets to be aligned in center reference. In this case, the sheets are positioned at the binding position owing to that the right-left aligning members 39F, 39R are moved toward the sheet center from the waiting positions by respectively the same amount.

In the following, description is provided with reference to FIG. 9. The first binding unit 47 is moved by the first stroke SL1 between a waiting position Wp1 (first waiting position) and the binding position Cp1. The second binding unit 51 is moved by the second stroke SL2 between a waiting position Wp2 (second waiting position) and the binding position Cp1. That is, the first binding unit 47 is caused to reciprocate between the first waiting position Wp1 and the binding position Cp1 along the travel rails 53, 54 (guide grooves, guide rods, or the like) and the second binding unit 51 is caused to reciprocate between the second waiting position Wp2 and the binding position Cp1 along guide rods 56*a*, 56*b* (or may be guide grooves).

Here, the binding position Cp1 is set at a sheet corner (hereinafter, called a set binding position). The first waiting position Wp1 and the second waiting position Wp2 satisfy following relations with the set binding position Cp1.

(1) The first waiting position Wp1 and the second waiting position Wp2 are located at opposite sides as sandwiching the set binding position Cp1.

(2) The first waiting position Wp1 is set at the outer side of the maximum size sheet on which a binding process is to be performed on the processing tray 37 or a binding processing position being farthest from the set binding position Cp1 on the processing tray 37 (a later-described multi-binding position Ma or the manual binding position Mp; the farthest binding position).

(3) The second waiting position Wp2 is set at the outer side of the sheet side edge aligned at the set binding position (outside a sheet placement area of the sheet placement face).

(4) The first stroke SL1 between the first waiting position Wp1 and the set binding position Cp1 is set larger (longer) than the second stroke SL2 between the second waiting position Wp2 and the set binding position Cp1.

Owing to that the first waiting position Wp1 and the second waiting position Wp2 are set at opposite sides with respect to the set binding position Cp1 as described above, it is possible that one unit is moved in a separating direction while the other unit is moved in a closing direction (a contrary retracting-closing operation). Further, owing to that the first stroke SL1 is set larger than the second stroke SL2, the binding processing position (the later-described multi-binding position Ma) of the first binding unit 47 can be set relatively freely. In contrast, the second binding unit 51 performs a binding process only at a previously-set binding position. According to the above, the length of the total movement stroke of the first and second binding units 47, 51 can be set small and the apparatus can be miniaturized.

Further, the later-described controller 95 moves the first and second binding units 47, 51 in a contrary manner so that the second binding unit 51 is located at the second waiting position Wp2 when the first binding unit 47 is at the set binding position Cp1 and the first binding unit 47 is located at the waiting position Wp1 when the second binding unit 51 is at the set binding position Cp1.

The contrary movement of the first and second binding units 47, 51 is performed with a method of (1) differentiating rotational amounts in accordance with movement strokes with separate drive motors, or (2) differentiating movement amounts between the first binding unit 47 and the second binding unit 51 with the same drive source.

Figure 10:
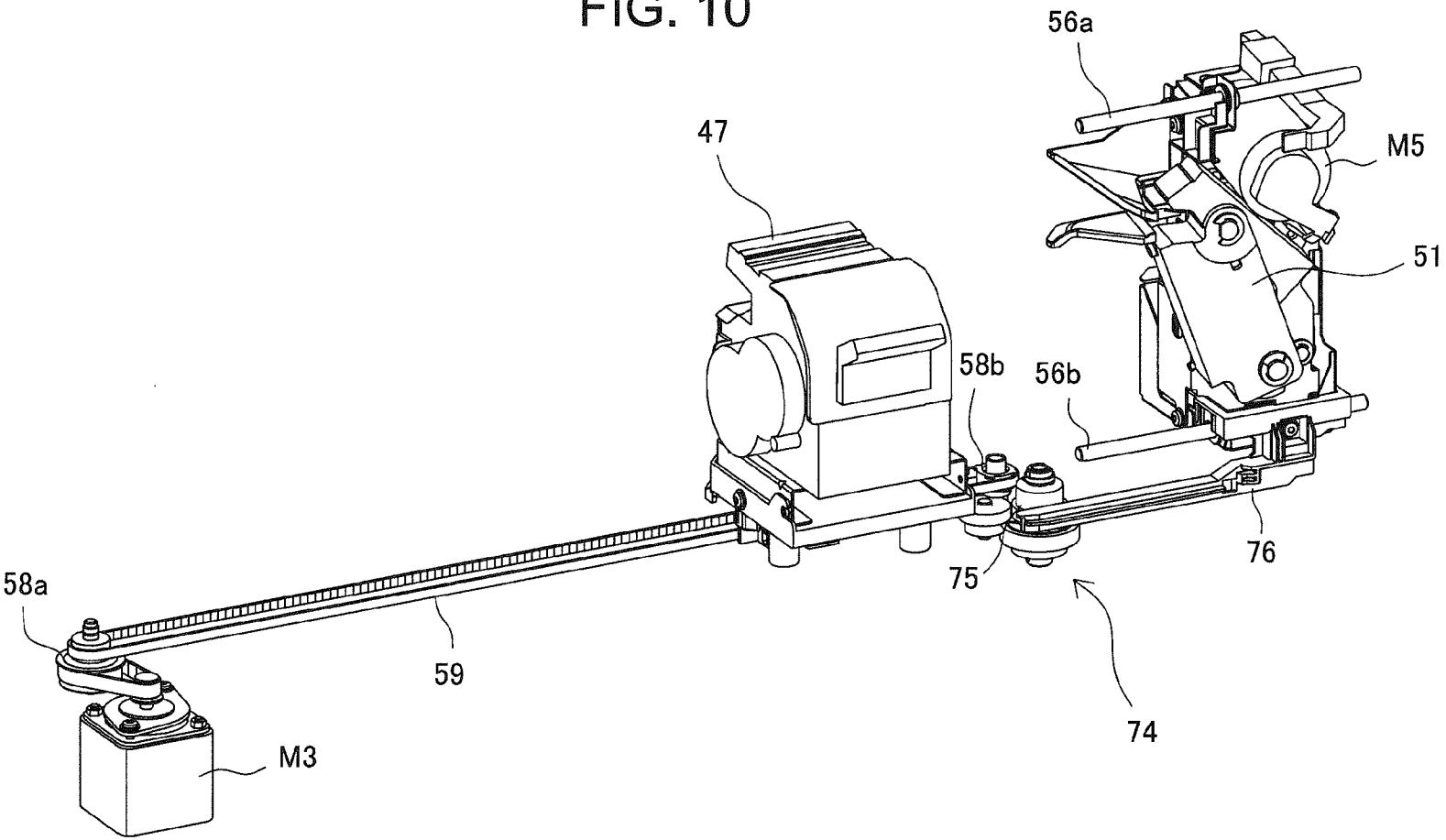
FIG. 10 is an explanatory view of a differential device of a binding device in the apparatus of FIG. 2.

FIG. 10 illustrates an embodiment to differentiate movement amounts of the first binding unit 47 and the second binding unit 51 with the same drive source. A right-left pair of pulleys 58*a*, 58*b* are arranged at the apparatus frame 27*b* along a movement area of the first binding unit 47 (in the right-left direction in FIG. 10). A timing belt (toothed belt) 59 is routed between the pulleys 58*a*, 58*b* and a drive motor M3 (stepping motor) is connected to one pulley 58*a*.

A transmitting pinion 75 is connected to the other pulley 58*b* via a differential device (transmitting device) 74. A rack 76 which is fixed to a frame of the second binding unit 51 is engaged with the transmitting pinion 75. The differential device 74 is structured with a gear mechanism, a slide clutch mechanism, or the combination of both the mechanisms having a transfer ratio matched to the difference between the first and second strokes SL1, SL2.

[Moving Mechanism of Stapling Unit]

As illustrated in FIG. 3, the stapling unit 47 is mounted on the apparatus frame (chassis frame) 27*b* movably by a predetermined stroke. The first travel rail 53 and the second travel rail 54 are arranged at the apparatus frame 27*b*. A travel rail face 53*x* is formed at the first travel rail 53 and a travel cam face 54*x* is formed at the second travel rail 54. The travel rail face 53*x* and the travel cam face 54*x* in mutual cooperation support the stapling unit 47 (hereinafter in this section, called a moving unit) to be capable of reciprocating by a predetermined stroke and control an angular posture thereof.

The first travel rail 53 and the second travel rail 54 are formed so that the travel rail face 53*x* and the travel cam face 54*x* allow the moving unit to reciprocate within a movement range of the moving unit (see FIG. 8). The timing belt 59 which is connected to the drive motor M3 is fixed to the moving unit (stapling unit) 47. The timing belt 59 is wound to the pair of pulleys 58*a*, 58*b* which are axially-supported by the apparatus frame 27*b* and the drive motor M3 is connected to one pulley. According to the above, the stapling unit 47 reciprocates by the stroke SL1 with forward and reverse rotation of the drive motor M3.

The moving unit 47 is engaged with the first and second travel rails 53, 54 as described below. As illustrated in FIG. 3, the moving unit 47 is provided with a first rolling roller (rail fitting member) 83 which is engaged with the travel rail face 53*x* and a second rolling roller (cam follower member) 84 which is engaged with the travel cam face 54*x*. Further, the moving unit 47 is provided with a ball-shaped sliding roller 47*x* (at two positions in the drawing) which is engaged with a support face of the frame 27*b*. Further, a guide roller 47*y* which is engaged with a bottom face of a bottom frame is formed at the moving unit 47 to prevent the moving unit 47 from floating from the bottom frame 27*b*.

According to the above structure, the moving unit 47 is supported by the bottom frame 27*b* movably via the sliding rollers 47*x* and the guide rollers 86. Further, the first rolling roller 83 and the second rolling roller 84 are rotated and moved along the travel rail face 53*x* and the travel cam face 54*x* respectively as following the travel rail face 53*x* and the travel cam face 54*x* respectively.

[Lifting-Lowering Mechanism of Stack Tray]

Figure 11:
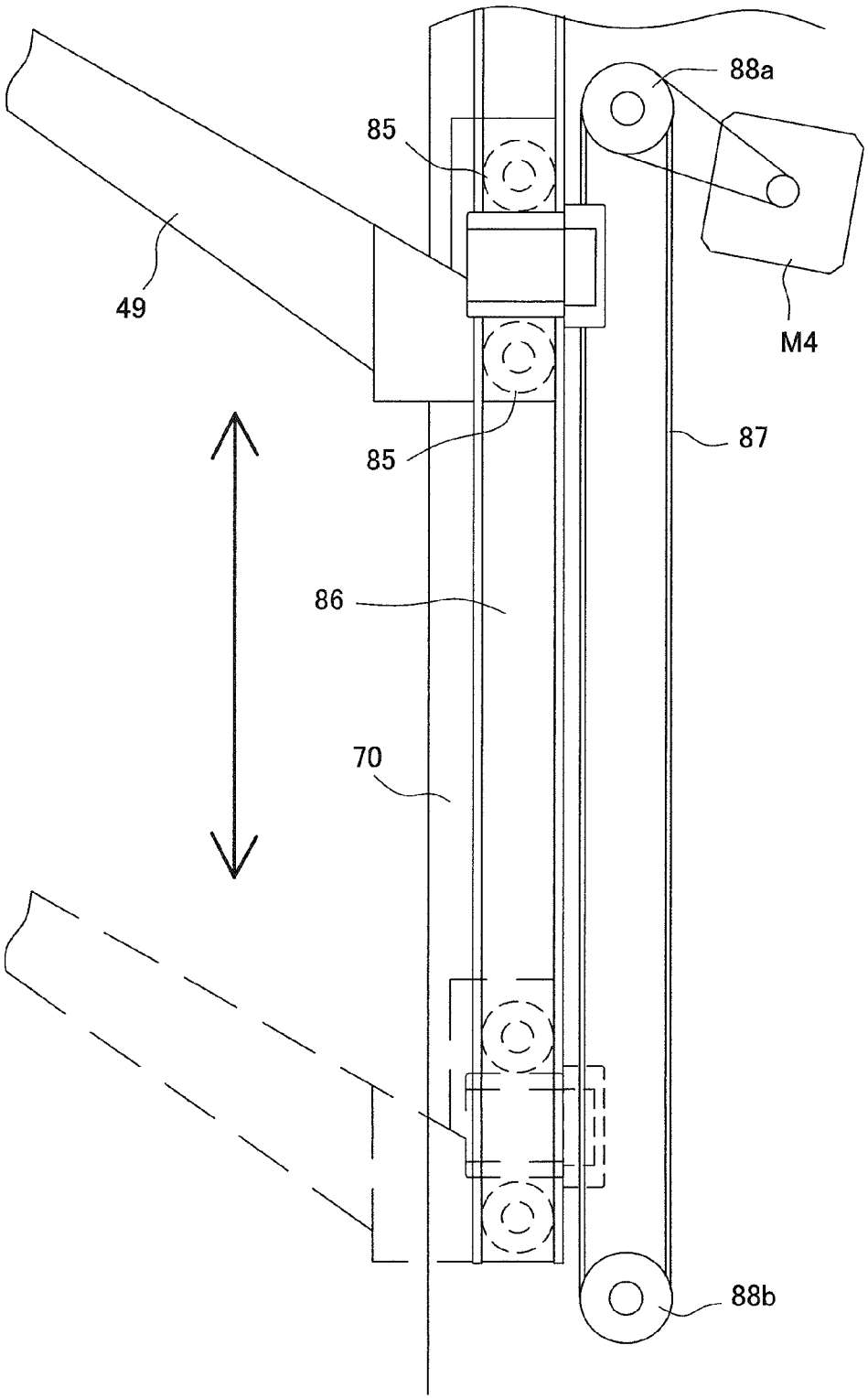
FIG. 11 is an explanatory view of a lifting-lowering mechanism of a stack tray in the apparatus of FIG. 2.

In the sheet post-processing apparatus B, the first tray 49 is arranged at the external cover 73 as illustrated in FIG. 11. The first tray 49 is configured to be lifted and lowered in accordance with a stack amount of sheets. As illustrated in FIG. 11, guide rollers 85 are arranged at two positions at upper and lower sides of a base end part of the first tray 49. The guide rollers 85 are fitted to and supported by a lifting-lowering guide 86 which is arranged at the apparatus frame 70. Then, the base end part of the first tray 49 is connected to a lifting-lowering belt 87. The lifting-lowering belt 87 is supported by an upper-lower pair of pulleys 88*a*, 88*b*. A lifting-lowering motor M4 is connected to one pulley (drive-side pulley) 88*a*. Thus, the first tray 49 is lifted and lowered in accordance with a stack amount of sheets owing to that the lifting-lowering motor M4 is rotationally controlled.

[Sheet Bundle Discharging Mechanism]

The sheet bundle discharging mechanism which discharges a bound sheet bundle toward the first tray 49 at the downstream side is arranged at the processing tray 37. For conveying a sheet bundle toward the downstream side, there have been known a method for conveying with a pair of rollers which are pressure-contacted to each other (a conveying roller device) and a conveying device for pushing out a sheet tailing end with a push-out member which is moved along a tray face from the upstream side to the downstream side. The illustrated apparatus adopts both the devices.

Figure 12A:
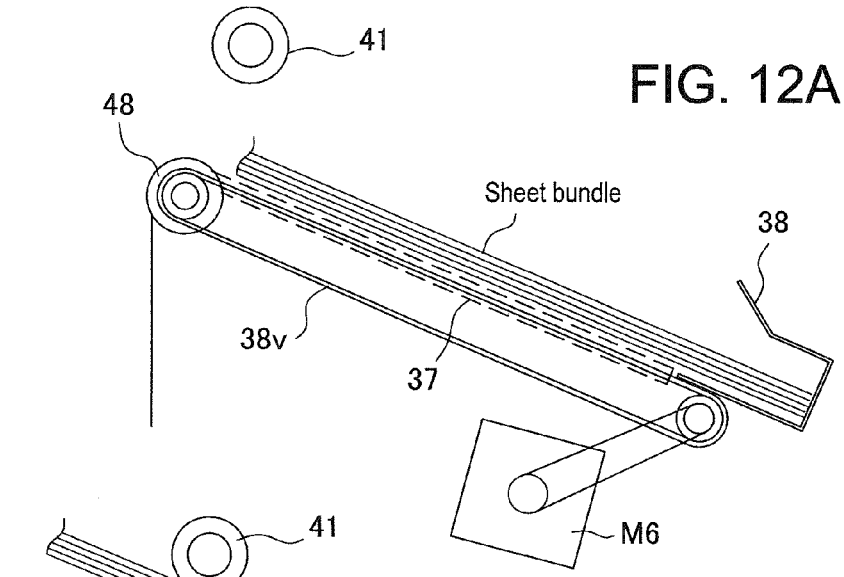
Figure 12B:
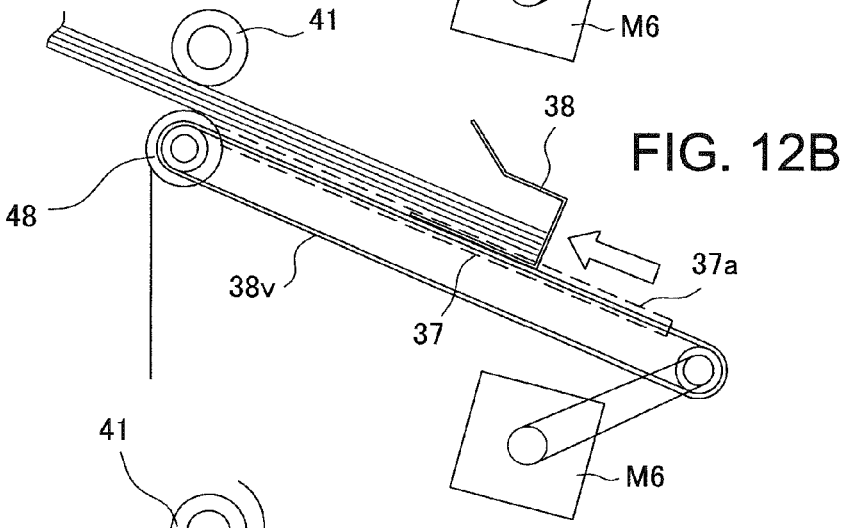
Figure 12C:
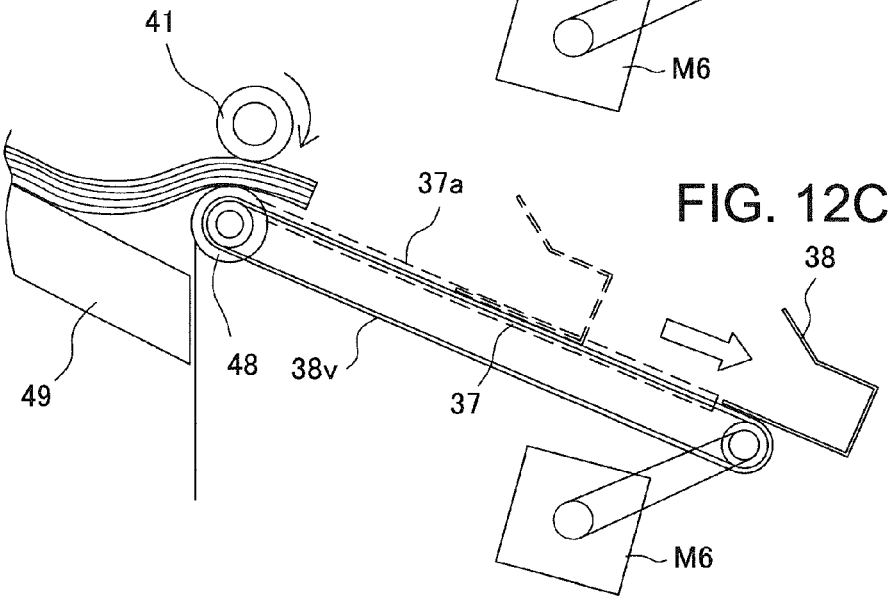

FIGS. 12A-12C illustrate the sheet bundle discharging mechanism. A conveying device is structured with a push-out projection 38 which conveys sheets along the processing tray 37 from the binding position (processing position) located at the upstream side to the stack tray (first tray) 49 at the downstream side, a conveying belt 38*v* which moves the push-out projection 38, and a drive motor M6 therefor. The driven roller 48 is arranged at a discharging port of the processing tray 37 (at the boundary between the sheet placement face 37*a* and the first tray 49). The lifting-lowering roller 41 which is pressure-contacted to the driven roller 48 is arranged in the abovementioned structure as being opposed thereto. Thus, the driven roller 48 and the lifting-lowering roller 41 structure a discharging roller device.

As described above, the conveying device 38, 38*v* which pushes out a sheet bundle from the upstream side to the downstream side and the discharging roller device 48, 41 which nips and discharges the sheet bundle are arranged at the processing tray 37. FIG. 12A illustrates a state that a sheet bundle is located at the binding position on the processing tray 37. At this time, the conveying device 38, 38*v* and the discharging roller device 48, 41 are in an operating state. FIG. 12B illustrates a midstream state of conveying the sheet bundle from the processing position to the downstream side. The sheet bundle is conveyed to the downstream side owing to movement of the push-out projection 38 and rotation of the discharging roller device 48, 41. FIG. 12C illustrates a state right before the sheet bundle is discharged onto the first tray 49 at the downstream side. On the processing tray 37, the sheet bundle is conveyed slowly (at low speed) to the downstream side with rotation of the discharging roller device 48, 41. At that time, the push-out projection 38 is kept waiting at the illustrated position as being returned to the initial position (moved rearward).

[Structure of Stapling Unit]

Figure 13A:
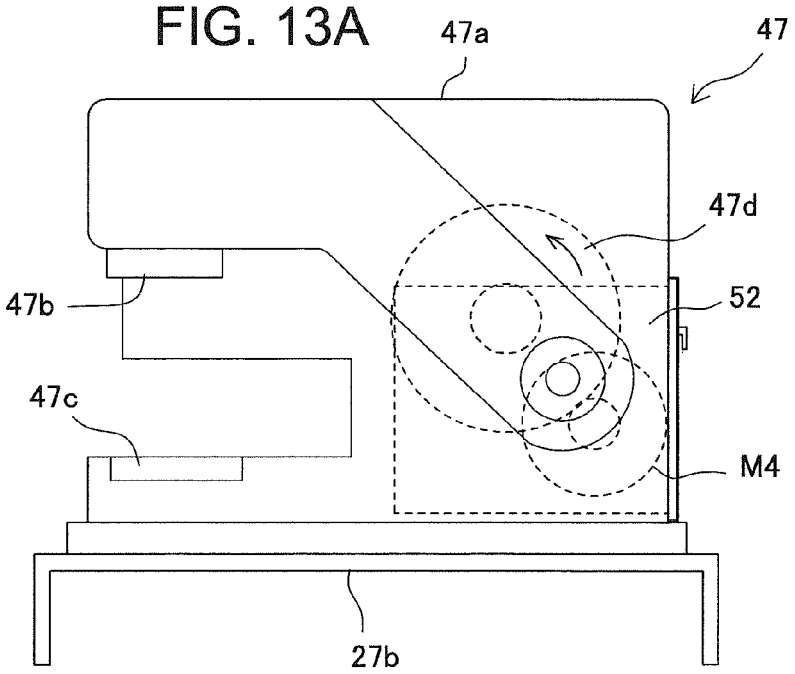

A structure of the stapling unit 47 will be described with reference to FIG. 13A. The stapling unit 47 is structured as a unit separated from the sheet post-processing apparatus B. The stapling unit 47 includes a box-shaped unit frame 47*a*, a drive cam 47*d* which is swingably axially-supported by the unit frame 47*a*, and a drive motor M4 which is mounted on the unit frame 47*a* to rotate the drive cam 47*d*.

A stapling head 47*b* and an anvil member 47*c* are arranged at the binding position as being mutually opposed. The stapling head 47*b* is vertically moved between a waiting position at the upper side and a stapling position at the lower side (the anvil member 26*c*) with the drive cam 47*d* and an urging spring (not illustrated). Further, the staple cartridge 52 is mounted on the unit frame 47*a* in a detachably attachable manner.

Linear blank staples are stored in the staple cartridge 52 and fed to the stapling head 47*b* by a staple feeding mechanism. A former member to fold a linear staple into a U-shape and a driver to cause the folded staple to bite into a sheet bundle are built in the stapling head 47*b*. With such a structure, the drive cam 47*d* is rotated by the drive motor M4 and energy is stored in the urging spring. When the rotational angle reaches a predetermined angle, the stapling head 47*b* is vigorously lowered toward the anvil member 47*c*. Owing to this action, a staple is caused to bite into a sheet bundle with the driver after being folded into a U-shape. Then, leading ends of the staple are folded by the anvil member 47*c*, so that the staple binding is completed.

The stapling feeding mechanism is built in between the staple cartridge 52 and the stapling head 47*b*. A sensor (empty sensor) to detect staple absence is arranged at the staple feeding mechanism. Further, a cartridge sensor (not illustrated) to detect whether or not the staple cartridge 52 is inserted is arranged at the unit frame 47*a*.

The illustrated staple cartridge 52 adopts a structure that belt-shaped connected staples are stacked and stored as being layered or are stored in a roll-shape in a box-shaped cartridge. Further, a circuit to control the abovementioned sensors and a circuit board to control the drive motor M4 are arranged at the unit frame 47*a* and transmit an alarm signal when the staple cartridge 52 is not mounted or the staple cartridge 52 is empty. Further, the stapling control circuit controls the drive motor M4 to perform the stapling operation with a staple signal and transmits an operation completion signal when the stapling head 47*b* is moved to an anvil position from the waiting position and returned to the waiting position.

[Structure of Non-Staple Binding Unit]

A structure of the non-staple binding unit 51 will be described with reference to FIG. 13B. As a binding device to perform a binding process on a sheet bundle without using a metal staple, there have been known a device to bind sheets by pressure-nipping a sheet bundle from front and back sides with pressurizing members which have concave-convex faces to be mutually engaged (a press binding apparatus), a device to bind sheets with folding after a slit-shaped cutout is formed at the sheet bundle (a cutout fold binding apparatus; see Japanese Patent Application Laid-open No. 2011-256008), and a device to bind sheets with a plant-derived resin string (resin string binding apparatus). Since a sheet bundle is bound without using a metal staple, such a method is known as an eco-binding method. In the following, a press binding mechanism is described as an example thereof.

With a press binding mechanism, concave-convex faces are formed on pressurizing faces 51*b*, 51*c* which can be pressure-contacted and separated to each other and a sheet bundle is pressure-nipped from front and back sides, so that sheets are deformed and bound. FIG. 13B illustrates the press binding unit 51. A movable frame member 51*d* is swingably axially-supported by a base frame member 51*a* and both the frame members 51*a*, 51*d* are swung about a support shaft 51*x* as being capable of being mutually pressure-contacted and separated. A follower roller 60*a* is arranged at the movable frame member 51*d* and is engaged with a drive cam 60*b* arranged at the base frame member 51*a*.

A drive motor M5 arranged at the base frame member 51*a* is connected to the drive cam 60*b* via a deceleration mechanism. Rotation of the drive motor M5 causes the drive cam 60*b* to be rotated and the movable frame member 51*d* is swung by a cam face (eccentric cam in FIG. 13B) thereof.

The lower pressurizing face 51*c* and the upper pressurizing face 51*b* are arranged respectively at the base frame member 51*a* and the movable frame member 51*d* as being mutually opposed. An urging spring (not illustrated) is arranged between the base frame member 51*a* and the movable frame member 51*d* to urge both the pressurizing faces 51*c*, 51*b* respectively in a direction to be separated.

Figure 13B:
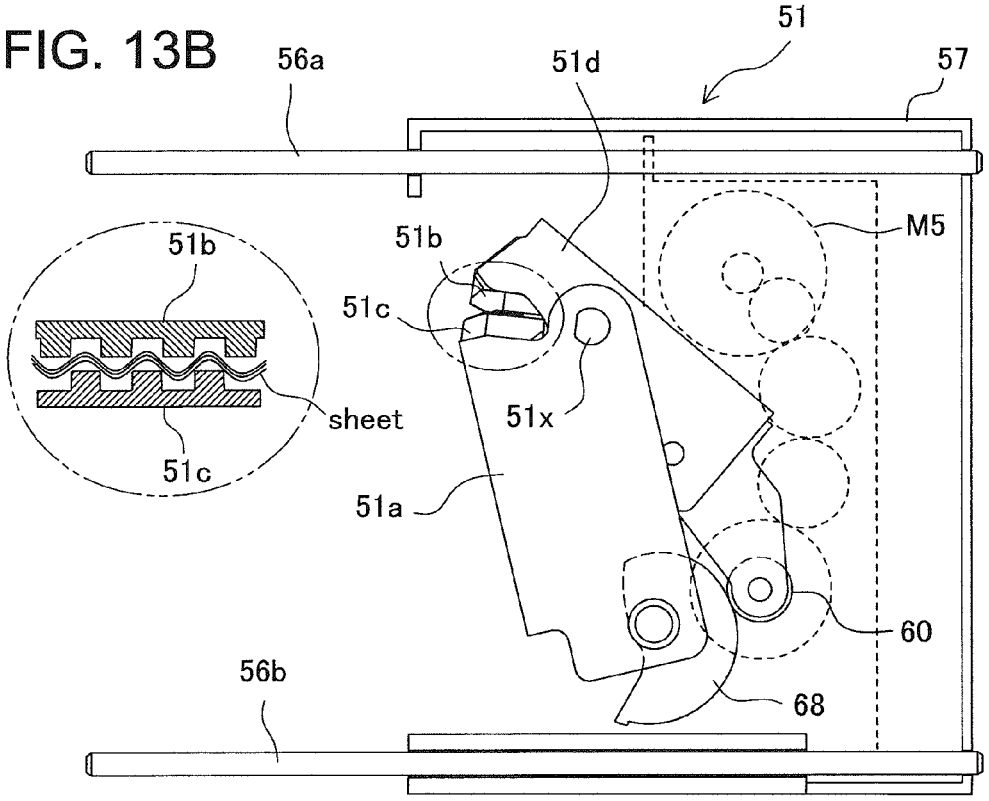

As illustrated in an enlarged view of FIG. 13B, convex stripes are formed on one of the upper pressurizing face 51*b* and the lower pressurizing face 51*c* and convex grooves to be matched therewith are formed on the other thereof. The convex stripes and the concave grooves are formed respectively into rib shapes as having predetermined length. A sheet bundle nipped between the upper pressurizing face 51*b* and the lower pressurizing face 51*c* is intimately contacted as being deformed into a corrugation shape. A position sensor (not illustrated) is arranged at the base frame member (unit frame) 51*a* and detects whether or not the upper and lower pressurizing faces 51*b*, 51*c* are at the pressurization positions or separated positions.

The press binding unit (the eco-binding unit, the second binding unit) 51 structured as described above is movably arranged on the first and second guide rods 56*a*, 56*b* (may be grooves as well) which are arranged at the apparatus frame 57 and reciprocates between the second waiting position Wp and the set binding position Cp1 for sheets stacked on the processing tray 37, as described above.

[Description of Control Configuration]

Figure 14:
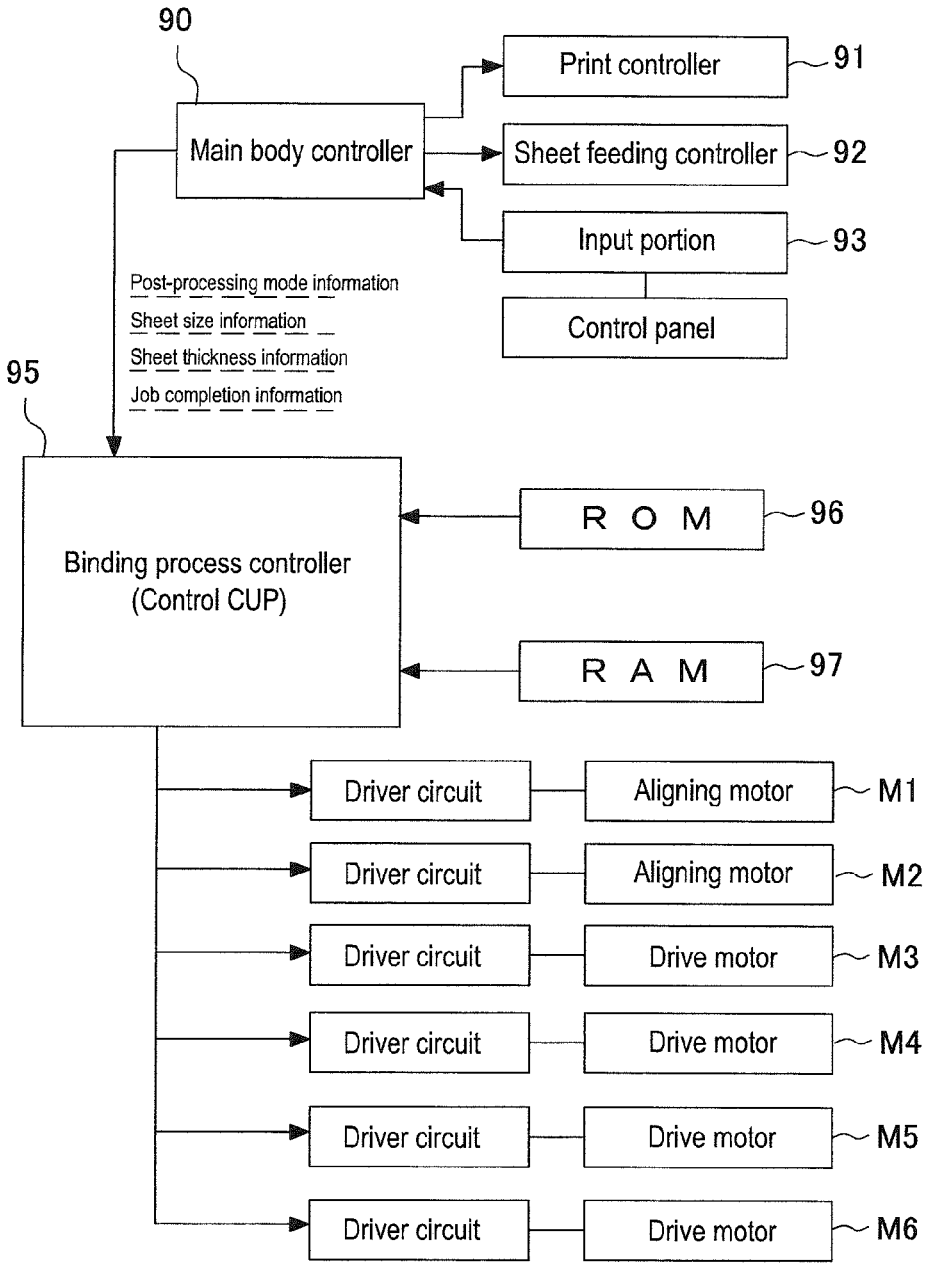
FIG. 14 is a block diagram illustrating a control configuration of the apparatus of FIG. 1.

A control configuration of the image forming system in FIG. 1 will be described with reference to FIG. 14. The image forming system illustrated in FIG. 14 includes a controller (hereinafter, called a main body controller) 90 for the image forming apparatus A and a controller (hereinafter, called a binding process controller) 95 for the sheet post-processing apparatus B. The main body controller 90 includes a print controller 91, a sheet feeding controller 92, and an input portion (control panel) 93.

Setting of an image forming mode and a post-processing mode is performed with the input portion (control panel) 93. The image forming mode requires setting of mode setting such as color/monochrome printing and double-face/single-face printing, and image forming conditions such as a sheet size, sheet quality, the number of copies, and enlarged/reduced printing. The post-processing mode is required to be set, for example, to a printout mode, a staple binding processing mode, an eco-binding processing mode, or a jog sorting mode. Further, the illustrated apparatus includes a manual binding mode. In this mode, operation of a sheet bundle binding process is performed offline as being separate from the main body controller 90 for the image forming apparatus A.

The main body controller 90 transfers, to the binding process controller 95, selection of the post-processing mode and data such as the number of sheets, the number of copies, and thickness of sheets on which images are formed. Further, the main body controller 90 transfers a job completion signal to the binding process controller 95 each time when image forming is completed.

The post-processing mode is described in the following. In the printout mode, a sheet from the sheet discharging port 35 is stored at the stack tray 49 via the processing tray 37 without a binding process performed. In this case, sheets are overlapped and stacked on the processing tray 37 and a stacked sheet bundle is discharged to the stack tray 49 with a jog completion signal from the main body controller 90.

In the staple binding processing mode, sheets from the sheet discharging port 35 are stacked and collated on the processing tray 37 and the sheet bundle is stored on the stack tray 49 after the binding process is performed thereon. In this case, sheets on which images are to be formed are specified by an operator basically to have the same thickness and size. In the staple binding processing mode, any of the multi-binding, right corner binding, and left corner binding is selected and specified. The binding positions thereof are as described above.

In the jog sorting mode, sheets are divided into a group whose sheets having images formed at the image forming apparatus A are offset and stacked and a group whose sheets are stacked without being offset. An offset sheet bundle and a non-offset sheet bundle are alternately stacked on the stack tray 49.

[Manual Binding Mode]

The manual setting portion 77 where an operator sets a sheet bundle on which the binding process is to be performed is arranged at the apparatus front side of the external cover 73. A sensor to detect a set sheet bundle is arranged at the setting face 77*b* of the manual setting portion 77. With a signal from the sensor, the later-described binding process controller 95 causes the stapling unit 47 to be moved to the manual binding position. Subsequently, when an operation switch is depressed by an operator, the binding process is performed.

Thus, in the manual binding mode, the binding process controller 95 and the main body controller 90 perform controlling offline. Here, in a case that the manual binding mode and the staple binding mode are to be performed concurrently, either mode is set to have priority.

[Binding Process Controller]

The binding process controller 95 causes the post-processing apparatus B to operate in accordance with the post-processing mode set by the image forming controller 90. The illustrated binding process controller 95 is structured with a control CPU (hereinafter, simply called a controller) to which a ROM 96 and a RAM 97 are connected. The control CPU 95 performs the later-described sheet discharging operation with control programs stored in the ROM 96 and control data stored in the RAM 97. Here, drive circuits for all the abovementioned drive motors are connected to the control CPU 95, so that start, stop, and forward-reverse rotation of the motors are controlled thereby.

[Sheet Discharging Operation Mode]

At the controller (main body controller) 90 for the image forming apparatus A, a post-processing (finishing) mode of image-formed sheets is set concurrently with image forming conditions. The illustrated apparatus is set to any of a staple binding mode, an eco-binding mode, a jog sorting mode, a bookbinding mode, a printout mode, an interruption mode, and a manual binding mode. In the following, operations of the respective modes will be described.

Figure 15:
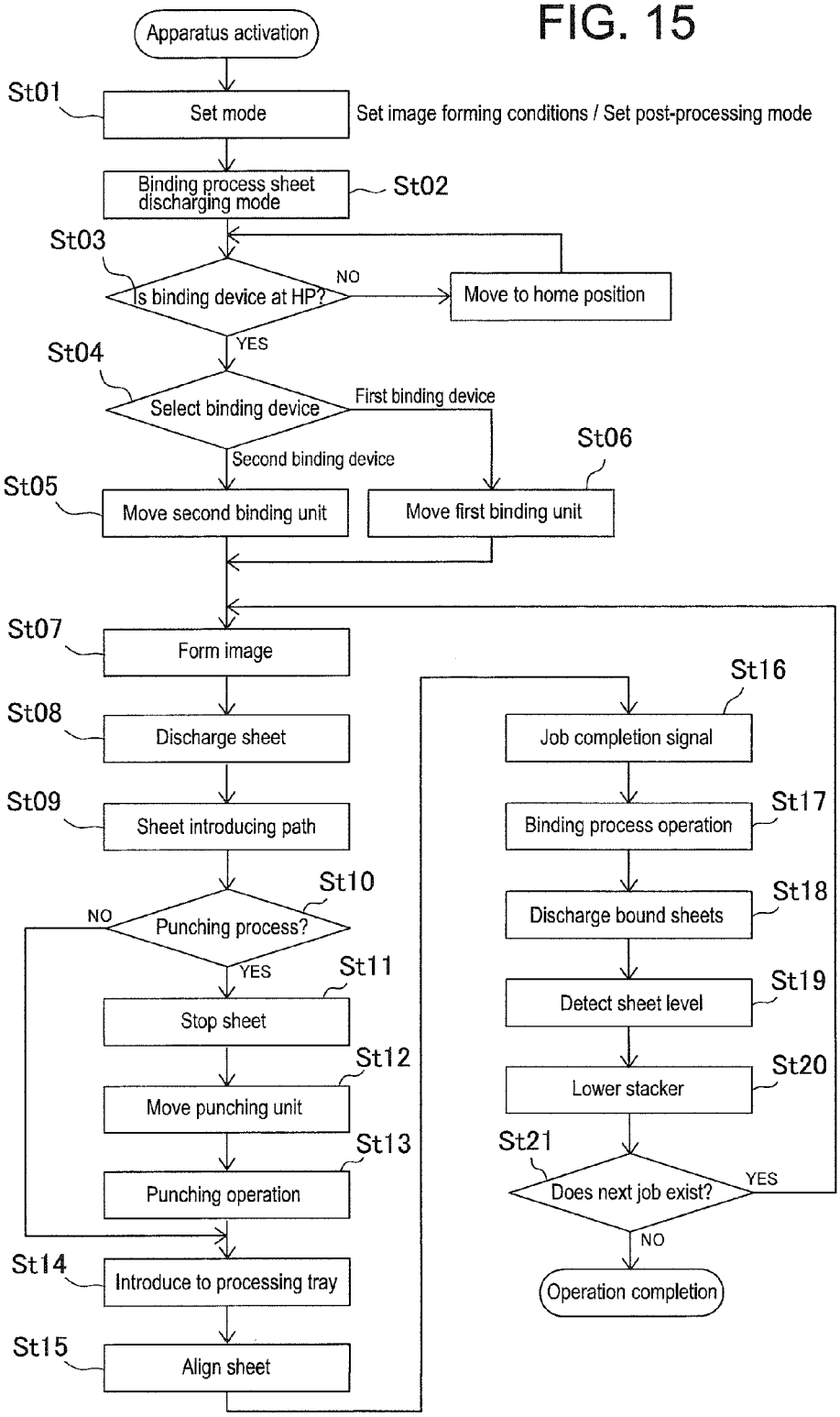
FIG. 15 is an operational flowchart of a binding process sheet discharging with the apparatus of FIG. 1.
Figure 16:
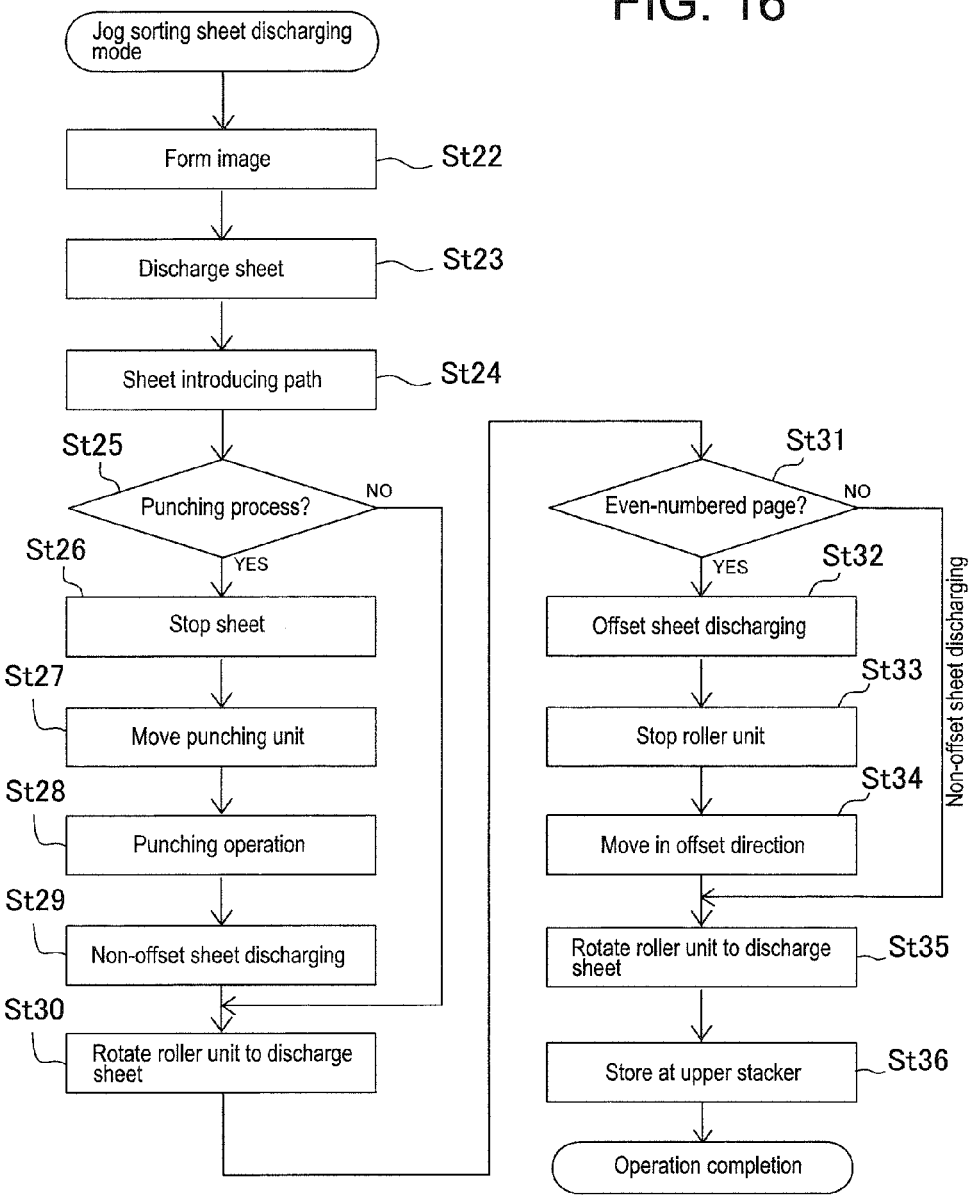
FIG. 16 is an operational flowchart of a jog sorting sheet discharging mode.
Figure 17A:
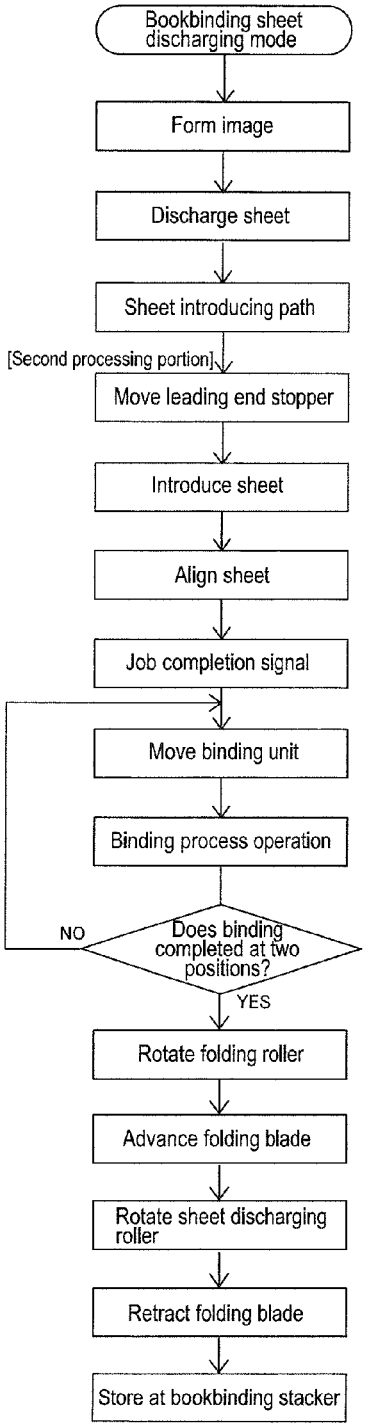
Figure 17B:
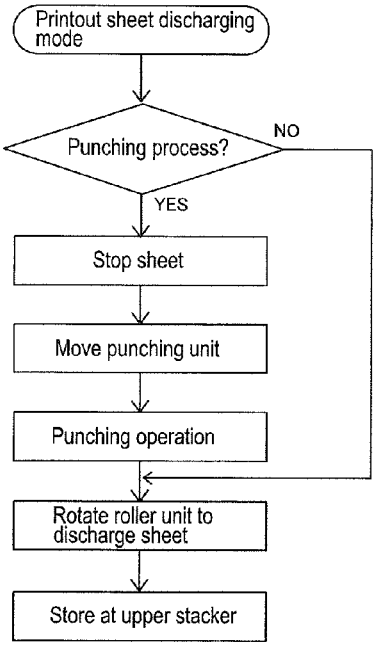

FIG. 15 is an explanatory view of operational flows to store a sheet bundle stacked on the processing tray 37 of the first processing portion B1 at the first tray 49 at the downstream side after the sheet bundle is staple-bound or eco-bound. FIG. 16 is an explanatory view of a sheet discharging mode to perform jog-sorting on sheets for each bundle as being an explanatory view of operational flows to store at the third tray 71 at the downstream side after sheets are offset in a direction perpendicular to the sheet discharging direction by a jog mechanism (roller shift mechanism; not illustrated) of the third processing portion B3 (sheet introducing path). FIGS. 17A-17B are explanatory views of the bookbinding discharging mode to perform bookbinding finishing on sheets at the second processing portion B2.

[Staple Binding Mode and Eco-Binding Mode at First Processing Portion]

In the following, description is provided with reference to FIG. 15. Setting of the post-processing mode is performed with the control panel 93 or the like of the image forming apparatus A (St01). Based on information of the post-processing mode setting (St02), the controller 95 for the sheet post-processing apparatus B causes the second binding unit 51 to be moved when the eco-binding process is specified (St05) and causes the first binding unit 47 to be moved when the staple binding process is specified (St06).

For performing the staple binding process, the first binding unit 47 is moved to the set binding position Cp1 and the second binding unit 51 is moved to the second waiting position Wp2. Here, when the unit position is set as a home position, the moving is performed after checking whether or not each unit is at the home position (St03).

Next, the image forming apparatus A forms an image (St07) and the image-formed sheet is discharged (St08). The sheet post-processing apparatus B receives the image-formed sheet fed to the introducing port 26 and conveys to the downstream side (St09). When a punching process is specified at that time (St10), the controller 95 causes the sheet to temporarily stop at a punch position (St11). Then, a punching unit 50 is moved in a direction perpendicular to the sheet discharging direction, the punching unit 50 is stopped after a specified punching position is determined with a sheet side edge detected by a sensor, and a punching operation is performed (St13).

When the punching process is not specified, the controller 95 causes the sheet to be received at the introducing port 26 and to be conveyed to the sheet discharging port 35. Then, the sheet is introduced to the processing tray 37 and positioned at a predetermined position by a positioning device (St15). The controller 95 causes sheets fed to the sheet discharging port 35 to be stacked and stored on the sheet placement face 37*a* of the processing tray 37 (St07 to St15). When a jog completion signal is received from the image forming apparatus A (St16), the controller 95 transmits a binding process instruction signal to the first binding unit 47 or the second binding unit 51. Accordingly, the first binding unit 47 or the second binding unit 51 performs the binding process (St17).

When the controller 95 receives a binding process completion signal from the first or second binding unit 47, 51, the bound sheet bundle is stored onto the first tray 49 at the downstream side by the sheet bundle discharging mechanism (St18). A sheet level detection sensor (not illustrated) is arranged at the first tray 49 and detects a stacked-sheet height. When the detection value exceeds a predetermined height, the first tray 49 is lowered (St20). Subsequently, the controller 95 determines whether or not a next job exists (St21) and the operation is completed.

Next, the jog sorting sheet discharging mode will be described with reference to FIG. 16. When the punching process is specified (St25), the controller 95 causes a sheet fed to the sheet introducing port 26 of the sheet introducing path 28 (St22 to St24) to temporarily stop at the punching position (St26). Then, the punching unit 50 is moved in a direction perpendicular to the sheet discharging direction (St27), the punching unit 50 is stopped after a specified punching position is determined with a sheet side edge detected by the sensor, and the punching operation is performed (St28).

Subsequently, the controller 95 causes a roller unit to be rotated in the sheet discharging direction (St30) to discharge a sheet from the third sheet discharging path 30 to the third tray 71 (St29). When the sheet is at an even-numbered page (St31, St32), the roller unit is stopped (St33) and the sheet is moved in a nipped state in a direction perpendicular to the sheet discharging direction by a previously-set offset amount (St34). Then, the controller 95 causes the roller unit to be rotated again in the sheet discharging direction (St35). At that time, the first path switching device 33 is shifted to guide the sheet from the introducing port 26 to the third sheet discharging path 30 and the sheet is stacked on the third tray 71 (St36).

Next, the bookbinding sheet discharging mode will be described with reference to FIGS. 17A-17B. Similarly to the above, an image-formed sheet is introduced to the sheet introducing path 28. The sheet is guided from the introducing port 26 to the second processing portion B2 and is abutted and regulated by the leading end regulating stopper 67. At that time, the controller 95, in advance, receives information of sheet size in the sheet discharging direction and sets a position of the leading end regulating stopper 67.

With a job completion signal from the image forming apparatus A, the binding unit (center binding unit) is moved to the sheet center and performs a binding process on sheets stacked at the second processing portion B2. When the binding process is completed at one position or two positions, the sheet bundle is moved to a folding position and a folding roller 64 is rotated. At the time when a folding blade 65 is advanced in the folding direction and the folding roller 64 is rotated by a predetermined amount, the folding blade 65 is retracted. Then, the folded-sheets are discharged in the sheet discharging direction by a sheet discharging roller 69 at the downstream side and stored at the second tray 61.

What is claimed is:

1. A sheet binding apparatus, comprising:

an apparatus frame;

a cover which covers the apparatus frame;

a setting portion which is arranged to set a sheet bundle; and a binding processing device which performs a binding process on a sheet bundle set at the setting portion, wherein the setting portion includes an opening through which sheets are inserted, a setting face on which sheets inserted through the opening are placed, and an abutting-regulating face which performs positioning of end edges of the sheets inserted through the opening, an openable-closable open-close cover is arranged at least at a part of the cover, the opening is formed at the open-close cover, and the abutting-regulating face is arranged at the apparatus frame separately from the open-close cover.

2. The sheet binding apparatus according to claim 1, wherein a height of a sheet bundle in a thickness direction capable of being inserted to the opening is set larger than a height of a sheet bundle in the thickness direction capable of being set on the setting face.

3. The sheet binding apparatus according to claim 1, wherein a height of a sheet bundle in a thickness direction capable of being inserted to the opening is set smaller than a height of a sheet bundle in the thickness direction capable of being set on the setting face.

4. The sheet binding apparatus according to claim 1,
further comprising an open-close sensor which detects an opened state of the open-close cover,
and a controller which transmits a signal to stop power supply to the binding processing device when the open-close sensor detects the opened state.

5. The sheet binding apparatus according to claim 1,
further comprising a stack portion on which sheets conveyed from a sheet conveying portion are stacked,
wherein the binding processing device binds sheets stacked on the stack portion.

6. The sheet binding apparatus according to claim 5,
wherein the binding processing device is attached to the apparatus frame as being movable between a first binding position where sheets on the stack portion are to be bound and a second binding position where sheets inserted through the opening are to be bound.

7. The sheet binding apparatus according to claim 1,
wherein the open-close cover is supported by a hinge connecting device in a openable and closable manner, and
the hinge connecting device is arranged at the apparatus frame so that the open-close cover is capable of supporting sheets which are supported on the setting face.

8. The sheet binding apparatus according to claim 1,
wherein the open-close cover forms an operation space for replenishing staples to the binding processing device in the opened state.

9. An image forming system, comprising:
an image forming apparatus which forms an image on a sheet; and
a sheet storing apparatus which stores sheets fed from the image forming apparatus,
wherein the sheet storing apparatus is the sheet binding apparatus according to claim 1.

10. The sheet binding apparatus according to claim 5,
wherein the setting face is arranged at a position to support sheets approximately on a same plane as a sheet placement face of the stack portion.

11. The sheet binding apparatus according to claim 1,
wherein the binding processing device is arranged at the apparatus frame.

12. The sheet binding apparatus according to claim 1,
wherein a sheet bundle manually inserted from an outside of the sheet binding apparatus is set in the setting portion.

13. A sheet binding apparatus, comprising:
an apparatus frame;
a moving portion having an opening through which a sheet bundle is inserted, and being movable relative to the apparatus frame, the opening being movable relative to the apparatus frame;
a regulating portion to which a sheet bundle inserted from the opening abuts to regulate a position of the sheet bundle; and
a binding unit which binds a sheet bundle inserted through the opening and positioned by the regulating portion,
wherein the regulating portion is arranged at the apparatus frame separately from the moving portion.

14. The sheet binding apparatus according to claim 13,
wherein the binding unit is arranged at the apparatus frame.

15. The sheet binding apparatus according to claim 13,
further comprising
a stack portion on which sheets conveyed from a sheet conveying portion are stacked,
wherein the binding unit binds sheets stacked on the stack portion.

16. The sheet binding apparatus according to claim 13,
wherein the opening receives a sheet bundle manually inserted from an outside of the sheet binding apparatus.

* * * * *